US012687336B2

(12) United States Patent
Chauhan et al.

(10) Patent No.: US 12,687,336 B2
(45) Date of Patent: Jul. 21, 2026

(54) VACUUM INSULATED STRUCTURE PRODUCT AND SIDE TRIM INSTALLATION

(71) Applicant: WHIRLPOOL CORPORATION, Benton Harbor, MI (US)

(72) Inventors: Vishal Brahmanand Chauhan, Palghar (IN); Narendra Ashok Kapure, Pune (IN); Mandar Gopalkrushna Kulkarni, Pune (IN); Rahul Sadanand Kumbhare, Gadchiroli (IN); Anup Bapu More, Pimpri Chinchwad (IN); Manjunathraddi Shivaraddi Navalgund, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 358 days.

(21) Appl. No.: 18/231,295

(22) Filed: Aug. 8, 2023

(65) Prior Publication Data

US 2025/0052481 A1 Feb. 13, 2025

(51) Int. Cl.
*F25D 23/06* (2006.01)
*F25D 23/10* (2006.01)

(52) U.S. Cl.
CPC ..... *F25D 23/063* (2013.01); *F25D 23/065* (2013.01); *F25D 23/10* (2013.01); *F25D 2201/14* (2013.01)

(58) Field of Classification Search
CPC ..... F25D 23/10; F25D 23/065; F25D 23/063; F25D 2201/14
See application file for complete search history.

(56) References Cited

U.S. PATENT DOCUMENTS

| | | | | |
|---|---|---|---|---|
| 4,970,874 | A | 11/1990 | Solak et al. | |
| 6,997,530 | B2 | 2/2006 | Avendano et al. | |
| 7,516,531 | B2 | 4/2009 | Crompton et al. | |
| 7,950,199 | B2 * | 5/2011 | Newhouse | A47B 96/00 52/278 |
| 8,079,652 | B2 | 12/2011 | Laible et al. | |
| 8,182,051 | B2 | 5/2012 | Laible et al. | |
| 8,439,460 | B2 | 5/2013 | Laible et al. | |
| 8,985,093 | B2 | 3/2015 | Ingersoll | |
| 9,032,675 | B2 | 5/2015 | Laible et al. | |

(Continued)

FOREIGN PATENT DOCUMENTS

| | | | | |
|---|---|---|---|---|
| CH | 644743 | A5 * | 8/1984 | A47B 77/08 |
| CN | 201802704 | U | 4/2011 | |

(Continued)

*Primary Examiner* — Andrew Roersma
(74) *Attorney, Agent, or Firm* — Price Heneveld LLP

(57) ABSTRACT

A vacuum insulated appliance includes a cabinet with a wrapper, a liner, and a vacuum insulated cavity defined between the wrapper and the liner. A pair of tap plate assemblies are coupled to the wrapper. The pair of tap plate assemblies each include a base, a tap plate with a first section slidably coupled to the base, and a second section perpendicular to the first section, where the second section is coupled to external cabinetry. Fasteners protrude outward from side panels of the wrapper. A pair of side trim pieces are coupled to the side panels. Each side trim piece defines trim apertures that permit extension of the fasteners through the trim apertures. The fasteners engage with the pair of side trim pieces, coupling the pair of side trim pieces to the side panels.

19 Claims, 18 Drawing Sheets

(56) References Cited

U.S. PATENT DOCUMENTS

| | | | | |
|---|---|---|---|---|
| 9,046,298 | B2 | 6/2015 | Laible et al. | |
| 11,175,089 | B2 | 11/2021 | Marinello et al. | |
| 2008/0036350 | A1 | 2/2008 | Crompton et al. | |
| 2022/0400851 | A1 * | 12/2022 | Harikrishnasamy ... | A47B 77/08 |
| 2022/0400858 | A1 | 12/2022 | Harikrishnasamy et al. | |

FOREIGN PATENT DOCUMENTS

| | | | | | |
|---|---|---|---|---|---|
| CN | 216409471 | U | * | 4/2022 | |
| DE | 1938800 | U | | 5/1966 | |
| DE | 7915767 | U1 | | 11/1980 | |
| DE | 102017130849 | A1 | * | 7/2018 | ..... A47B 77/08 |
| EP | 0441363 | A2 | | 8/1991 | |
| KR | 100512725 | B1 | | 9/2005 | |
| KR | 101455867 | B1 | | 11/2014 | |
| WO | 2023077873 | A1 | | 5/2023 | |

* cited by examiner

VACUUM INSULATED STRUCTURE PRODUCT AND SIDE TRIM INSTALLATION

BACKGROUND OF THE DISCLOSURE

The present disclosure generally relates to a vacuum insulated appliance, and more specifically, to a vacuum insulated appliance with a trim assembly.

SUMMARY OF THE DISCLOSURE

According to one aspect of the present disclosure, a vacuum insulated appliance includes a cabinet with a wrapper that includes a top panel, a first side panel, and a second side panel and a liner coupled to the wrapper. The vacuum insulated cavity is defined between the wrapper and the liner. A pair of tap plate assemblies are coupled to the top panel of the wrapper. Each of the pair of tap plate assemblies includes a base coupled to the top panel and a tap plate with a first section slidably coupled to the base and a second section that extends from the first section and away from the top panel. The second section is configured to couple to an external structure that is spaced from the cabinet. The vacuum insulated appliance also includes fasteners protruding outward from the first side panel and the second side panel of the wrapper, respectively, and a pair of side trim pieces coupled to the first side panel and the second side panel, respectively. Each side trim piece defines trim apertures. The fasteners extend through the trim apertures and engage with the pair of side trim pieces to couple the pair of side trim pieces to the first side panel and the second side panel, respectively.

According to another aspect of the present disclosure, a refrigeration appliance includes a cabinet that includes a wrapper with a top panel, a bottom panel opposing the top panel, a first side panel, and a second side panel opposing the first side panel and a liner coupled to the wrapper. The refrigeration appliance includes a cover panel coupled to a front portion of the wrapper, a first pair of tap plate assemblies coupled to the top panel of the wrapper, and a second pair of tap plate assemblies coupled to the cover panel. Each of the first pair of tap plate assemblies and each of the second pair of tap plate assemblies include a base, a tap plate with a first section slidably coupled to the base, and a second section extending from the first section, where the second section is configured to couple to external cabinetry. The refrigeration appliance further includes a pair of side trim pieces that are coupled to the first side panel and the second side panel of the wrapper. The pair of side trim pieces extend from a bottom panel of the wrapper to the top panel of the wrapper.

According to yet another aspect of the present disclosure, a vacuum insulated appliance includes a cabinet. The cabinet includes a wrapper with a top panel, a bottom panel opposing the top panel, a first side panel, and a second side panel opposing the first side panel, and a liner coupled to the wrapper. The cabinet also includes a cover panel coupled to a front portion of the wrapper and tap plate assemblies coupled to at least one of the wrapper and the cover panel. The tap plate assemblies each include a base, studs extending outward from the at least one of the wrapper and the cover panel, and a tap plate with a first section slidably coupled to the base and a second section extending from the first section and away from the at least one of the wrapper and the cover panel. Each of the first sections define a slot that permits extension of the studs through the first section, respectively. The second section is configured to couple to external cabinetry.

These and other features, advantages, and objects of the present disclosure will be further understood and appreciated by those skilled in the art by reference to the following specification, claims, and appended drawings.

Figure 1:
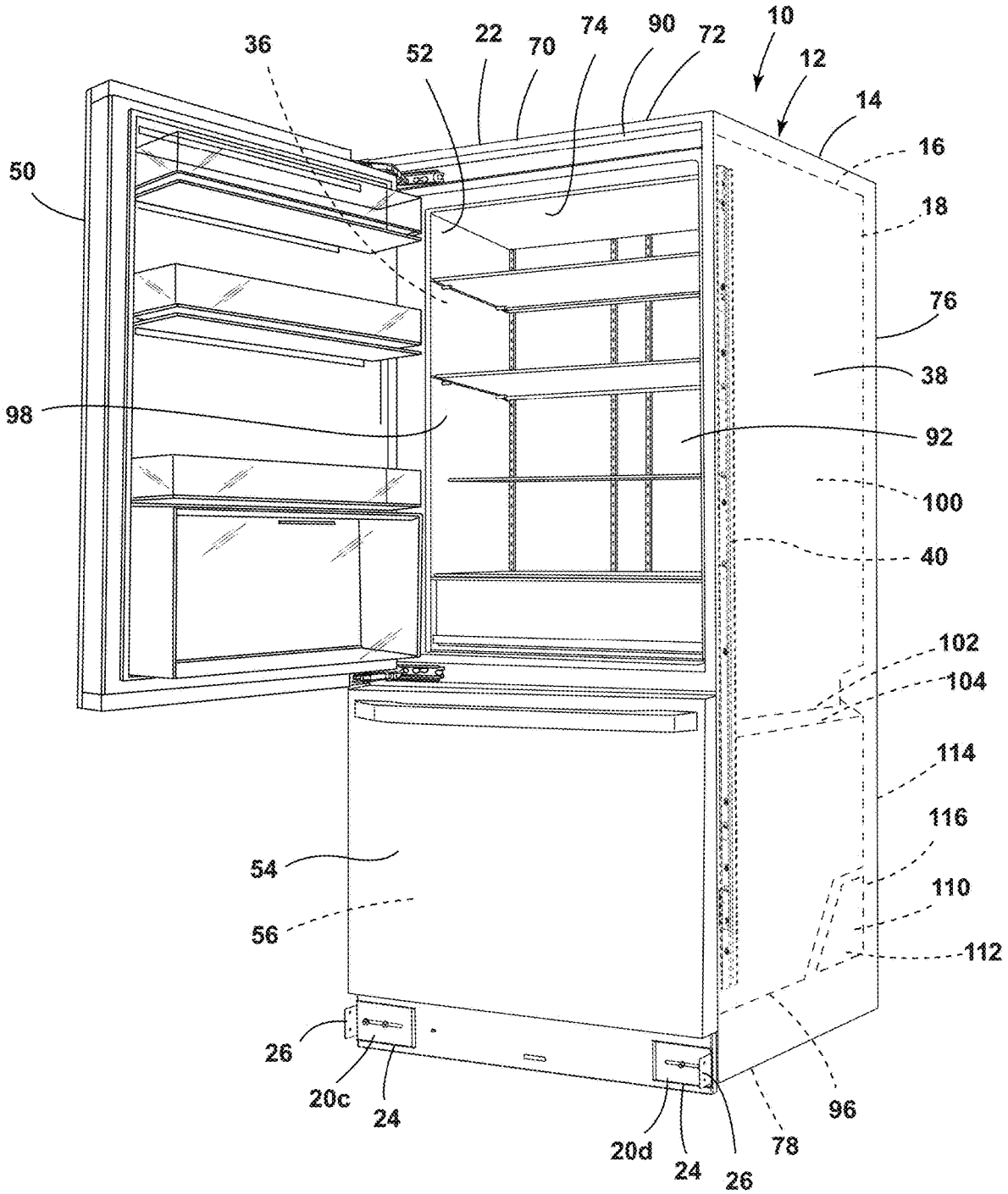
FIG. 1 is a side perspective view of a vacuum insulated appliance, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a refrigeration appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-19, reference numeral 10 generally designates an appliance that includes a cabinet 12. The cabinet 12 includes a wrapper 14 and a liner 16 coupled to the wrapper 14. A vacuum insulated cavity 18 is defined between the wrapper 14 and the liner 16. Tap plate assemblies 20, including tap plate assemblies 20*a*-20*d*, are coupled to the appliance 10. The tap plate assemblies 20*a*, 20*b* are coupled to a top panel 22 of the wrapper 14. Each of the tap plate assemblies 20*a*, 20*b* includes a base 24 coupled to the top panel 22 and a tap plate 26 with a first section 28 slidably coupled to the base 24 and a second section 30 that extends from the first section 28 and away from the top panel 22. The second section 30 is configured to couple to an external structure 32. Fasteners 34 protrude outward from a first side panel 36 and a second side panel 38 of the wrapper 14, respectively. A pair of side trim pieces 40, including side trim pieces 40*a*, 40*b*, are coupled to the first side panel 36 and the second side panel 38, respectively. Each side trim piece 40 defines trim apertures 42 through which the fasteners 34 extend. The fasteners 34 engage with the pair of side trim pieces 40 to couple the pair of side trim pieces 40 to the first side panel 36 and the second side panel 38, respectively.

Figure 2:
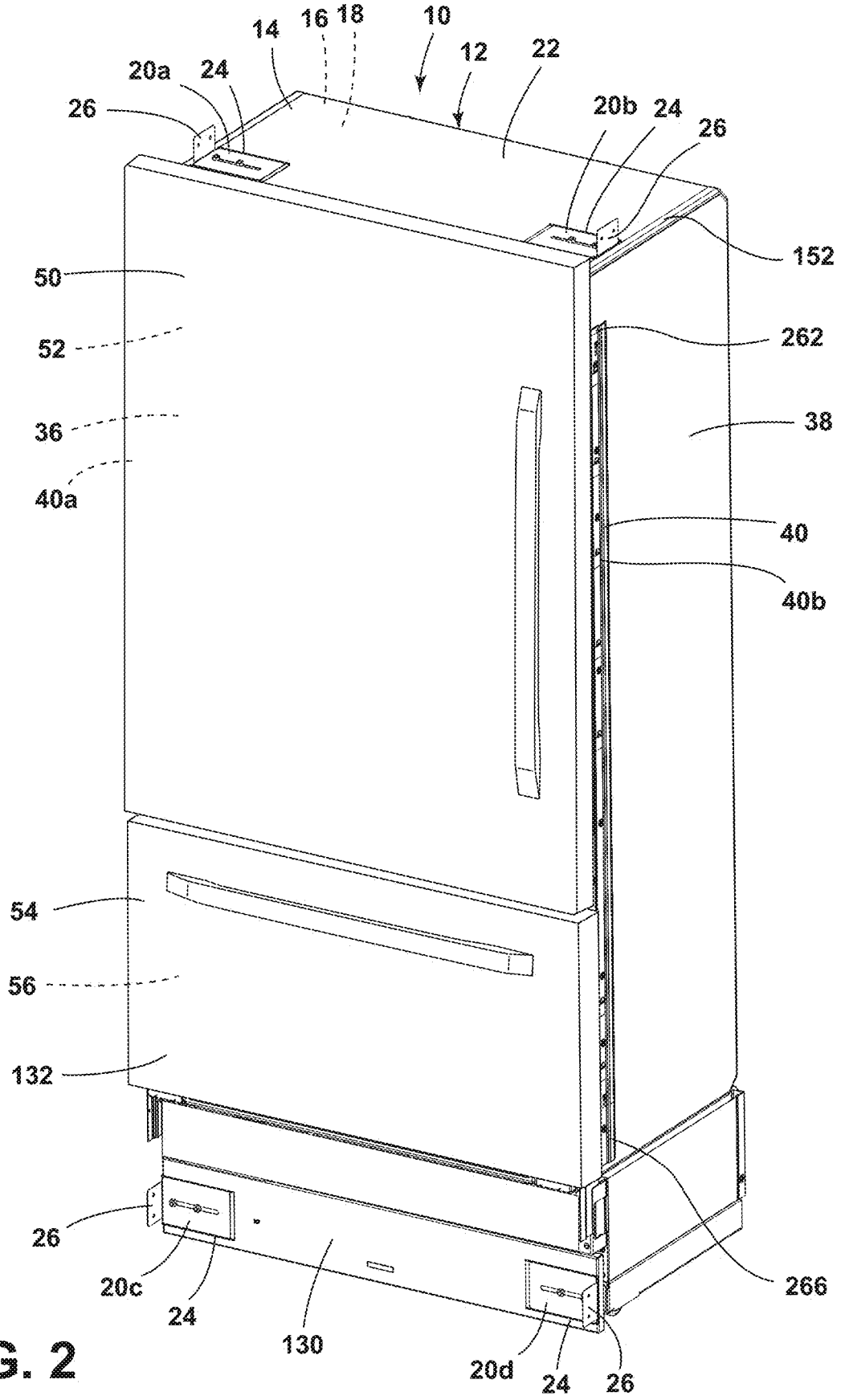
FIG. 2 is a side perspective view of a vacuum insulated appliance with tap plate assemblies, according to the present disclosure.

Referring to FIGS. 1 and 2, the appliance 10 is illustrated as a refrigerator appliance with a door assembly 50 operably providing access to a refrigerator compartment 52 and a lower pull-out drawer 54 providing access to the freezer compartment 56. However, it is contemplated that the cabinet 12, with the wrapper 14, the liner 16, and the vacuum insulated cavity 18 may be used with a variety of appliances, structures, or storage purposes other than with an appliance. Moreover, the illustrated appliance 10 is a bottom-mount refrigerator. In non-limiting examples, the appliance 10 can be a bottom-mount refrigerator, a bottom-mount French door refrigerator, and/or a five-door French door refrigerator.

In the depicted example of FIG. 1, the cabinet 12 includes the wrapper 14 that is coupled to the liner 16 and a trim breaker 70 to define the vacuum insulated cavity 18. The wrapper 14 includes a front edge 72 defining an opening 74, a rear panel 76 opposing the front edge 72, the top panel 22, and a bottom panel 78 opposite the top panel 22 and extending between the front edge 72 and the rear panel 76. The wrapper 14 also includes the first side panel 36 and the opposing second side panel 38 that each extends between the front edge 72 and the rear panel 76. The wrapper 14 may be made from a material at least partially resistant to bending, deformation, or otherwise being formed in response to an inward compressive force. These materials for the wrapper 14, include, but are not limited to, metals, polymers, metal alloys, combinations thereof, and/or other similar substantially rigid materials that can be used for vacuum insulated structures.

Referring further to FIGS. 1 and 2, the liner 16 is at least partially enclosed by the wrapper 14. The liner 16 includes a front edge 90, a rear section 92 that opposes the front edge 90, a top section 94, and a bottom section 96 opposing the top section 94 and extending between the front edge 90 and the rear section 92. The liner 16 also includes side sections 98, 100 that each extends between the top section 94 and the bottom section 96. Further, the liner 16 may have intermediate sections 102, 104 extending between the refrigerator compartment 52 and freezer compartment 56. One intermediate section 102 may form a lower portion of the refrigerator compartment 52, while the second intermediate section 104 may form an upper portion of the freezer compartment 56. The intermediate sections 102, 104 may extend from the front edge 90 to the rear section 92 and are configured to separate the compartments 52, 56 and define a mullion region therebetween. In such configurations, the liner 16 may be multiple components.

As illustrated in FIGS. 1 and 2, each section 92, 94, 96, 98, 100 of the liner 16 is proximate a respective panel 76, 22, 78, 36, 38 of the wrapper 14. Similarly, each section 92, 94, 96, 98, 100 of the liner 16 may have a shape and size that coincides with the shape and size of the respective panel 76, 22, 78, 36, 38 of the wrapper 14. The liner 16 may be made from a material at least partially resistant to bending, deformation, or otherwise being formed in response to the inward compressive force. These materials for the liner 16 include, but are not limited to, metals, polymers, metal alloys, combinations thereof, and/or other similar substantially rigid materials that can be used for vacuum insulated structures.

The trim breaker 70 couples the wrapper 14 to the liner 16 to define and seal the vacuum insulated cavity 18. The trim breaker 70 is generally disposed proximate to the opening 74 of the wrapper 14. The trim breaker 70 includes one or more channels that receive the front edge 72 of the wrapper 14 and the front edge 90 of the liner 16. An adhesive is disposed within one or more of the channels to couple the front edge 72 of the wrapper 14 and the front edge 90 of the liner 16 to the trim breaker 70 such that a sealed interface is defined. The wrapper 14, the liner 16, and the trim breaker 70 are sealed and airtight such that air can neither escape nor enter into the vacuum insulated cavity 18 between the wrapper 14 and the liner 16.

The appliance 10 illustrated in FIGS. 1-4 defines the vacuum insulated cavity 18, in which one or more insulation materials may be disposed. The insulation materials may be a carbon-based powder and/or silicone oxide-based materials, however, it is generally contemplated that other insulation materials may be used. Additionally, the insulation materials can be free-flowing materials that can be poured, blown, compacted, or otherwise disposed within the vacuum insulated cavity 18. This free-flowing material can be in the form of various silica-based materials, such as fumed silica, precipitated silica, nano-sized, and/or micro-sized aerogel, powder, rice husk ash, powder, perlite, glass spheres, hollow glass spheres, cenospheres, diatomaceous earth, combinations thereof, and/or other similar insulating particulate materials.

In various examples, the one or more insulation materials may substantially fill the vacuum insulated cavity 18 to form a substantially continuous layer between the wrapper 14 and the liner 16. A vacuum, or at least a partial vacuum, may be defined within the vacuum insulated cavity 18 and may define a pressure differential between an exterior of the appliance 10 and the vacuum insulated cavity 18. This pressure differential may serve to define the inward compressive force that may be exerted upon one and/or both of the wrapper 14 and the liner 16. Further, the door assembly 50 and the lower pull-out drawer 54 may also be vacuum insulated structures. In such examples, the door assembly 50 and/or the lower pull-out drawer 54 may have a structural wrapper defining a vacuum insulated cavity with insulating materials and defining an at least partial vacuum.

Referring again to FIGS. 1 and 2, the appliance 10 includes a machine compartment 110 that contains components of a refrigerant system 112. The machine compartment 110 is shown below a bottom portion 114 of the rear panel 76 with an inner surface that may be at least partially defined by the cabinet 12. In some examples, a top region 116 of the machine compartment 110 is at least partially defined by the bottom portion 114 of the rear panel 76 such that the machine compartment 110 is positioned below the rear panel 76. According to various aspects, the machine compartment 110 operably houses various components or portions of components of the refrigerant system 112. The machine compartment 110 may also extend from a rear of the appliance 10 to a front of the appliance 10, forming a bottom section between the wrapper 14 and the liner 16 or below the wrapper 14.

Figure 3:
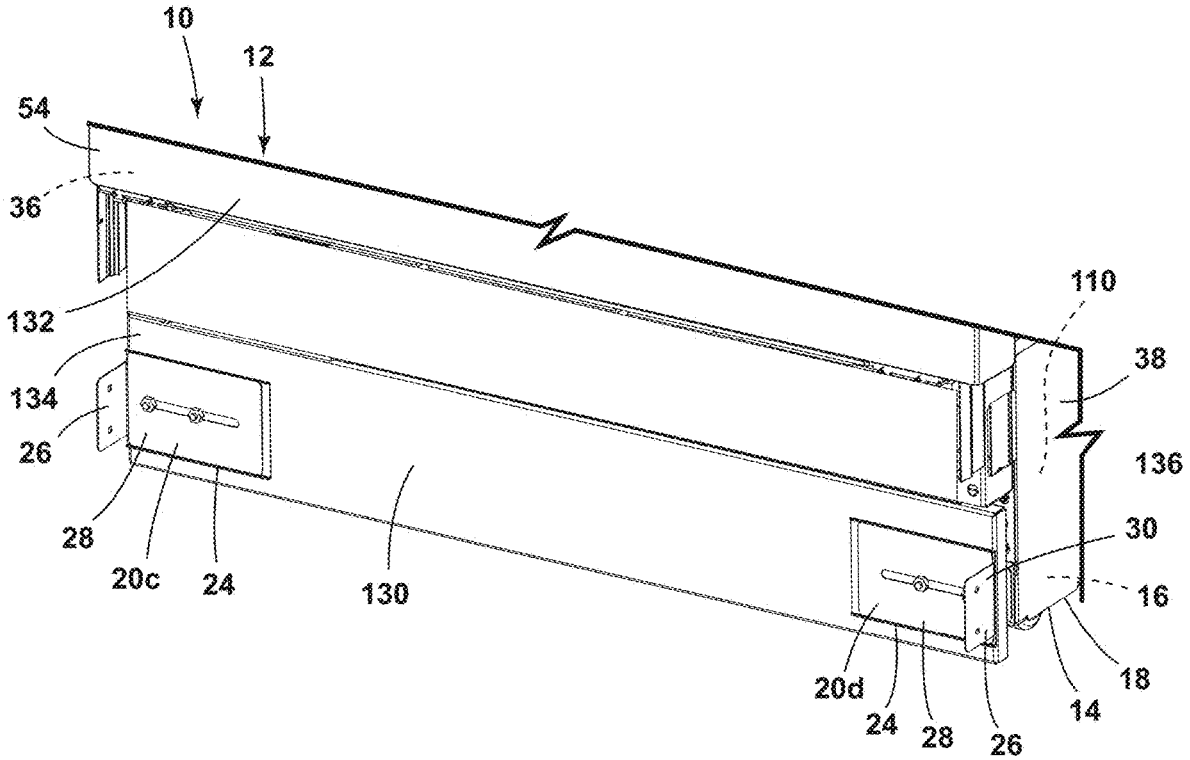
FIG. 3 is an enlarged, partial side perspective view of a bottom portion a vacuum insulated appliance with a cover plate and tap plate assemblies coupled to the cover plate, according to the present disclosure.
Figure 4:
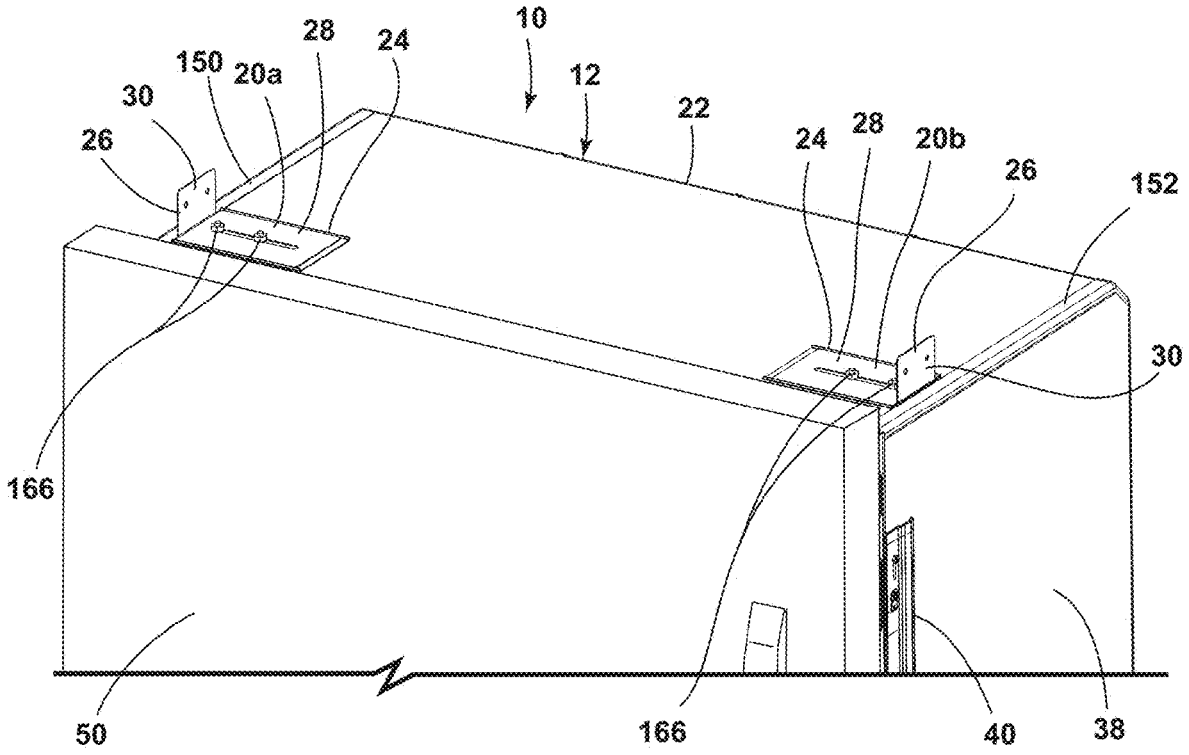
FIG. 4 is an enlarged, partial side perspective view of a top portion a vacuum insulated appliance with tap plate assemblies coupled to a wrapper top panel, according to the present disclosure.

Referring further to FIGS. 2 and 3, the appliance 10 may include a cover panel 130 that at least partially extends across the machine compartment 110. In some examples, the cover panel 130 is coupled to a front portion 132 of the cabinet 12. In various examples, the cover panel 130 may be disposed below the freezer compartment 56 and proximate the front edge 90 of the liner 16, the front edge 72 of the wrapper 14, and the bottom panel 78 of the wrapper 14. The cover panel 130 may be coupled to a first end 134 of the machine compartment 110, and laterally extend to be coupled to a second end 136 of the machine compartment 110 that opposes the first end 134. According to various aspects, the cover panel 130 may extend upward from the bottom panel 78 and at least partially towards the top region 116 of the machine compartment 110 such that at least a portion of the machine compartment 110 is hidden behind the cover panel 130 when viewing the front portion 132 of the cabinet 12. In some aspects, the cover panel 130 may extend downward from the bottom panel 78 and towards the external structure 32, such as a floor that is below the appliance 10. In such aspects, the cover panel 130 may reduce or hide a gap that may occur between the bottom panel 78 and the external structure 32 that is downward of the appliance 10.

Referring to FIGS. 2-8, the appliance 10, in some examples, includes the tap plate assembly 20. The tap plate assembly 20 may be coupled to various locations throughout the appliance 10. For example, the tap plate assembly 20 may be coupled to the top panel 22 of the wrapper 14, the rear panel 76 of the wrapper 14, and/or the cover panel 130, or one of other various locations throughout the appliance 10.

The appliance 10 may include the plurality of tap plate assemblies 20. For example, the plurality of tap plate assemblies 20 may include the first tap plate assembly 20*a* and the second tap plate assembly 20*b* coupled to opposing ends 150, 152 of the top panel 22 of the wrapper 14, and the third tap plate assembly 20*c* and the fourth tap plate assembly 20*d* that are aligned generally perpendicular relative to the first tap plate assembly 20*a* and the second tap plate assembly 20*b* and are coupled to the cover panel 130 proximate the first end 134 and the second end 136 of the machine compartment 110. The first rap plate assembly 20*a*, the second tap plate assembly 20*b*, the third tap plate assembly 20*c*, and the fourth tap plate assembly 20*d* may collectively be referred to herein as the tap plate assemblies 20.

Additionally, it is generally contemplated that the appliance 10 may include one or more tap plate assemblies 20 disposed in various positions throughout the appliance 10. It is further contemplated that the tap plate assemblies 20 can be disposed in various positions throughout or along the appliance 10 such that each tap plate assembly 20, or a portion thereof, can translate and/or extend in a coinciding and/or differing direction than various other tap plate assemblies 20. For example, the first tap plate assembly 20*a*, which is disposed on the top panel 22 of the wrapper 14, and the third tap plate assembly 20*c*, which is disposed on the cover panel 130, may both be translatable beyond the first side panel 36, and the second tap plate assembly 20*b*, which is disposed on the top panel 22, and the fourth tap plate assembly 20*d*, which is disposed on the cover panel 130, may both be translatable beyond the second side panel 38.

Referring still to FIGS. 2 and 3, as well as FIGS. 4-8, each tap plate assembly 20 includes the base 24. The bases 24 may be couplable to the wrapper 14, the cover panel 130, or various other areas and/or components of the appliance 10. Each base 24 includes a base section 160 that generally defines an elongated or oblong shape, such as a rectangular shape, an oval shape, or various other practicable shapes. Each base section 160 defines a first stud aperture 162 and a second stud aperture 164 that may be aligned along a width of the appliance 10 and have a shape that coincides with the first stud aperture 162. The first stud apertures 162 and the second stud apertures 164 operably receive a pair of studs 166 that extend through the base section 160, respectively. The studs 166 can then be fastened and/or welded to inner walls of the base sections 160 that encircle the stud aperture 162, 164, as provided herein.

Figure 5:
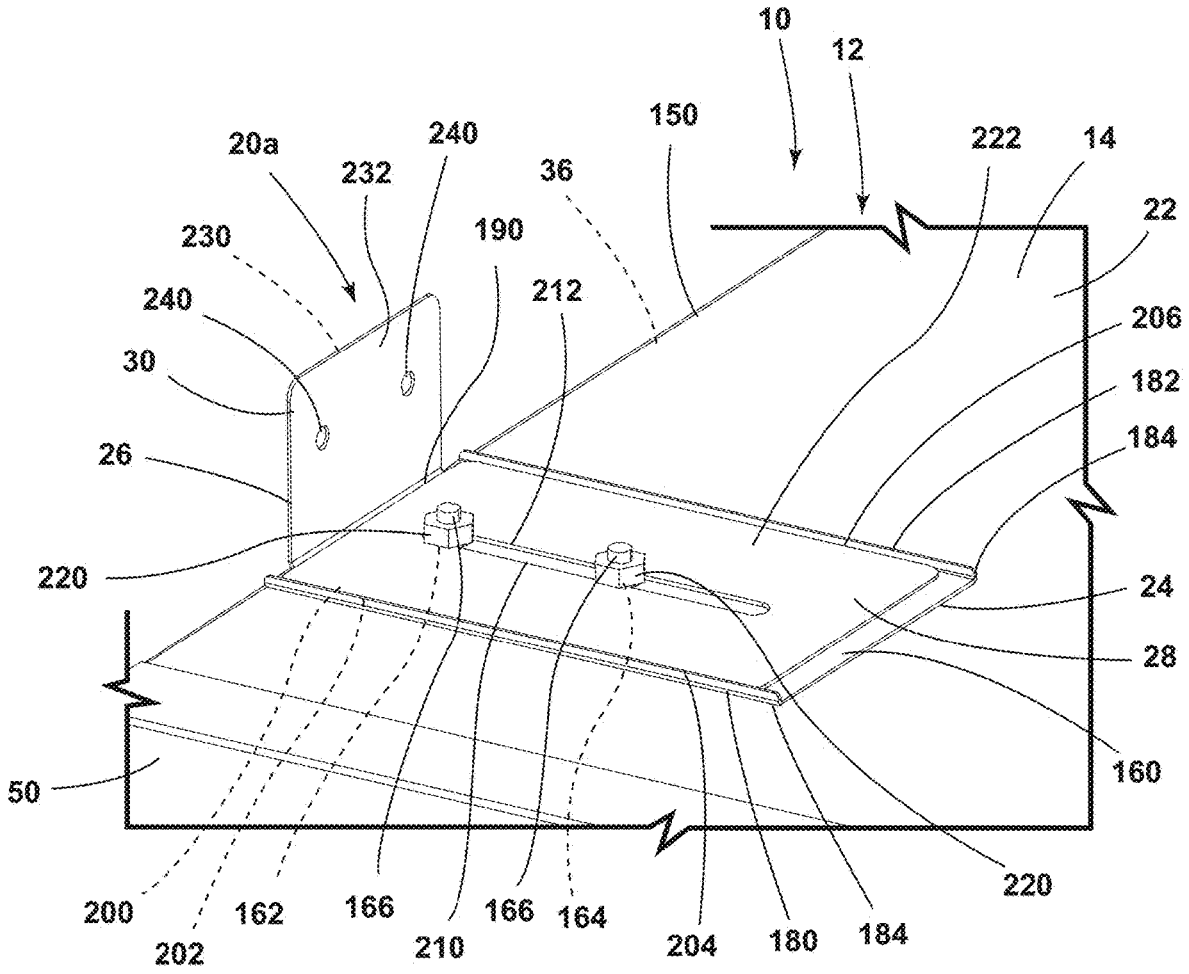
FIG. 5 is a side perspective view of a tap plate assembly, according to the present disclosure.
Figure 6:
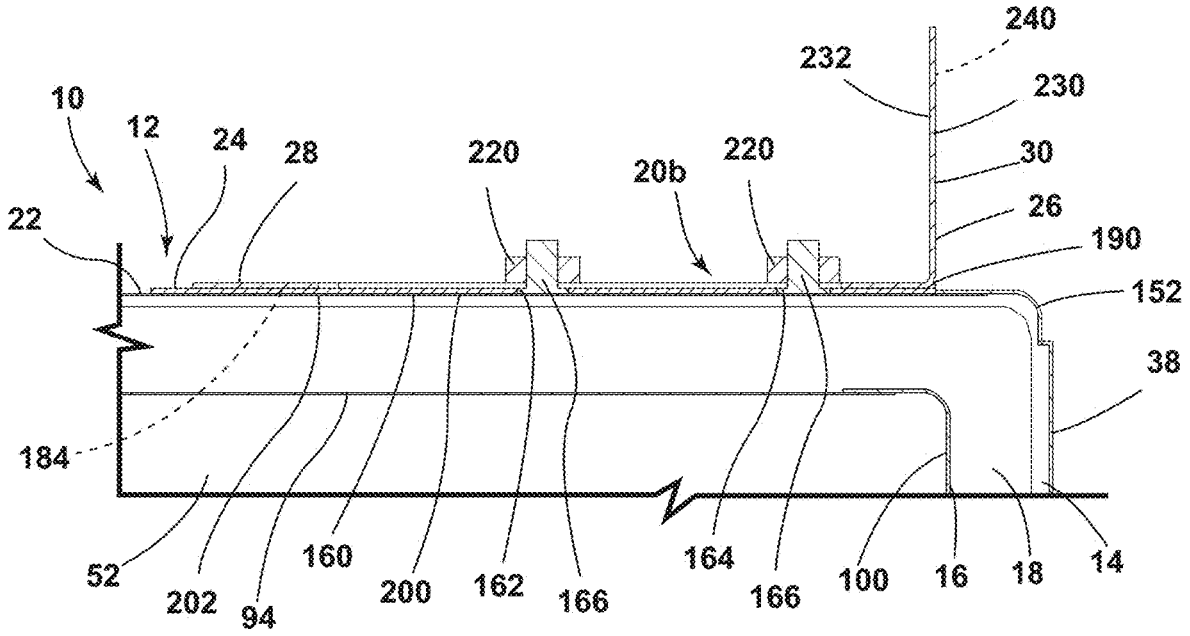
FIG. 6 is a cross-sectional view of a tap plate assembly, according to the present disclosure.
Figure 7:
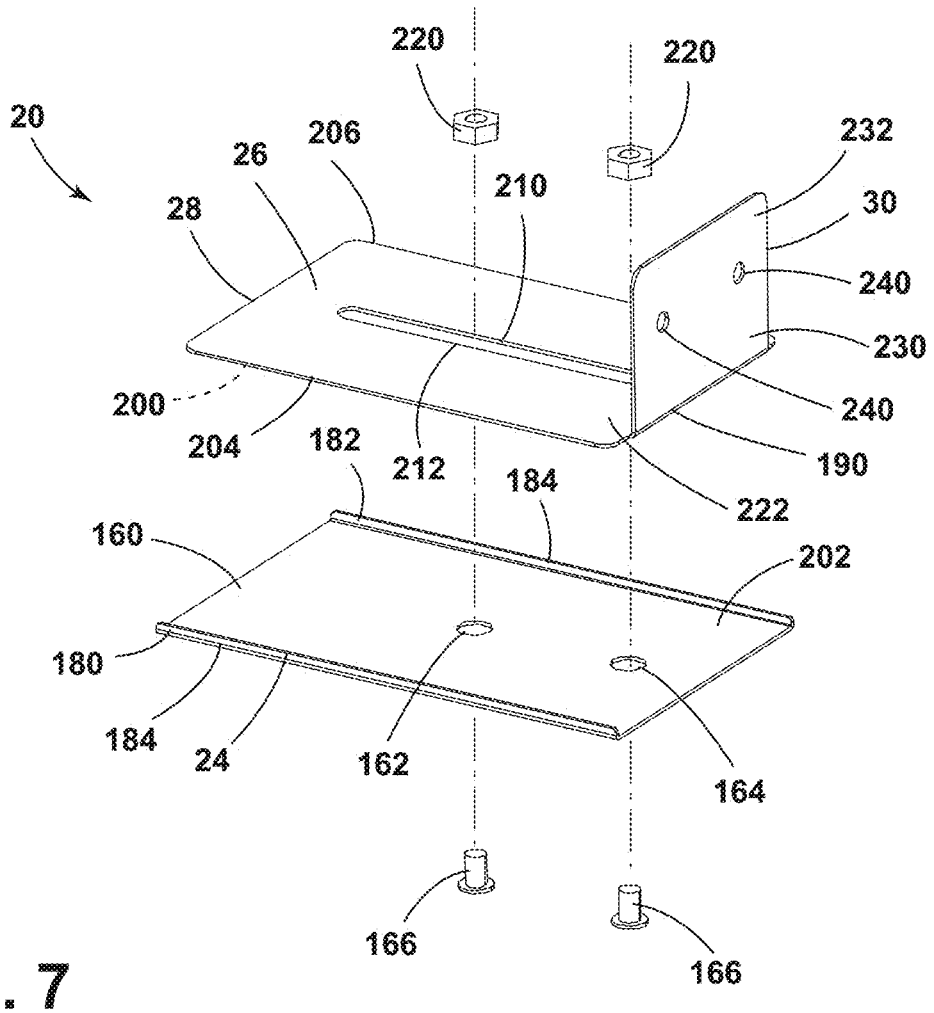
FIG. 7 is an exploded, side perspective view of a tap plate assembly, according to the present disclosure.
Figure 8:
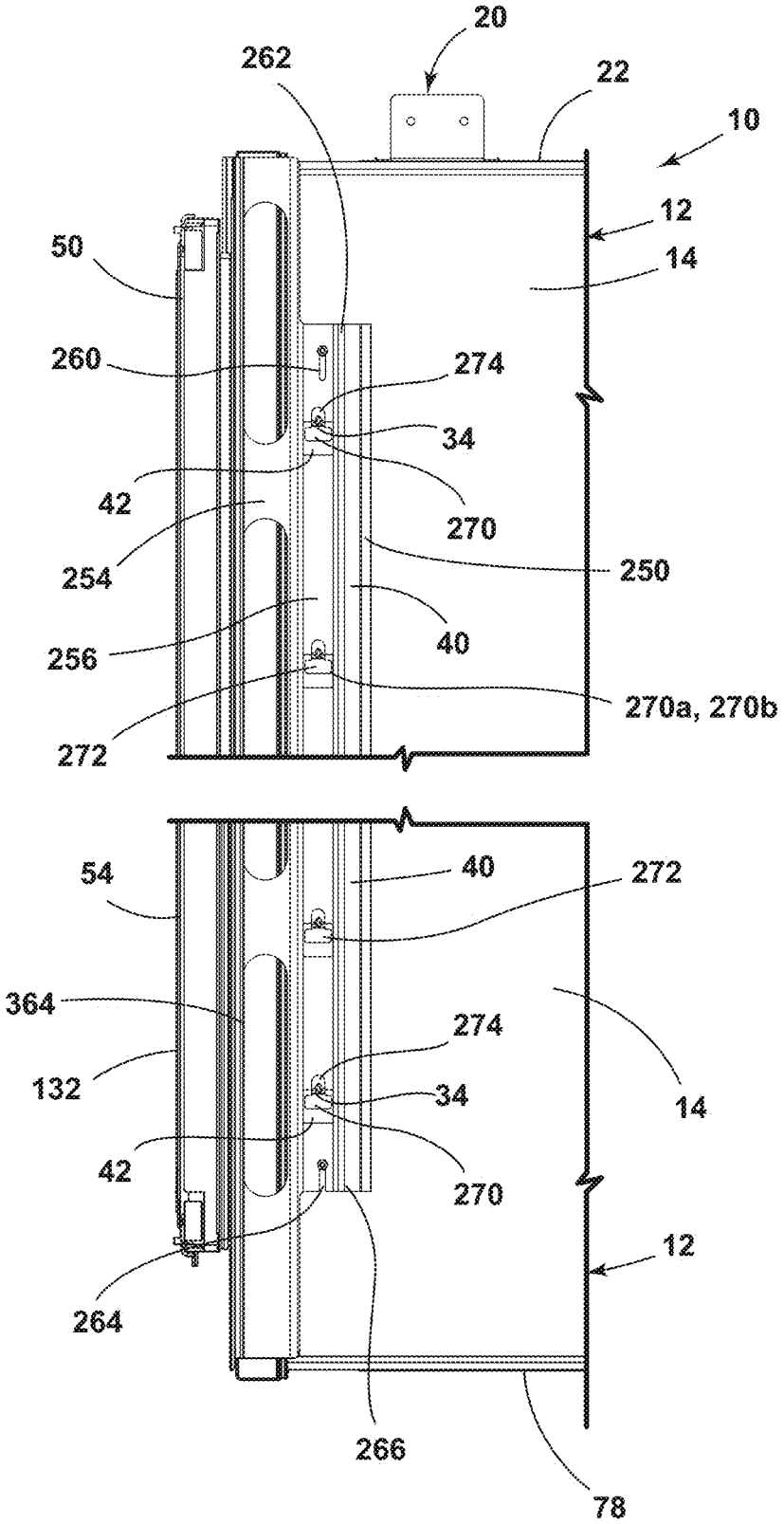
FIG. 8 is a partial side elevational view of a top portion and a bottom portion of a vacuum insulated appliance with a side trim piece and a plurality of clips, according to the present disclosure.

Referring still to FIGS. 5-7, each base 24 includes a first side section 180 and a second side section 182 on opposing sides of the base section 160. Each side section 180, 182 may extend upward from the base section 160, and then inward and towards the opposing side section 180, 182 such that a lip 184 is defined by each side section 180, 182. Each lip 184 generally defines a size and shape to slidably engage, and remain engaged with the respective side section 180, 182. Additionally, or alternatively, it is generally contemplated that each side section 180, 182 may extend upward from the base section 160 at various distances from the wrapper 14, and that each side section 180, 182 may extend inward towards the opposing side section 180, 182 to various lengths such that each lip 184 may define various heights, widths, and/or lengths. It is further generally contemplated that each lip 184 may also include various bends and/or shapes. For example, each lip 184 may include an at least partially rounded portion.

Referring again to FIGS. 2-7, each tap plate assembly 20 includes the tap plate 26 that slidably couples to the base 24. Each tap plate 26 includes the first section 28 and the second section 30, which extends outward from the first section 28, away from the wrapper 14, and intersects with the first section 28 at a tap plate corner section 190. In this way, the first section 28, second section 30, and tap plate corner section 190 generally define an L-shape. Additionally or alternatively, it is generally contemplated that the second section 30 may extend acutely, perpendicular to, obtusely, or parallel to the respective first section 28 such that various shapes may be formed.

It is further generally contemplated, in aspects where the appliance 10 includes multiple tap plate assemblies 20, that multiple tap plates 26 may be disposed throughout or along the appliance 10 in a coinciding or differing position. For example, in the illustrated example shown in FIG. 2, the first sections 28 of the first and second tap plate assemblies 20*a*, 20*b*, respectively, are each parallel with the top panel 22, while the first sections 28 of the third and fourth tap plate assemblies 20*c*, 20*d* are each parallel with the cover panel 130 and generally perpendicular to the first sections 28 of the first and second tap plate assemblies 20*a*, 20*b*. Additionally, the second sections 30 of the first and second tap plate assemblies 20*a*, 20*b* each extend upward from the top panel 22 and are generally perpendicular to the second sections 30 of the third and fourth tap plate assemblies 20*c*, 20*d*, respectively, which extend outward from the cover panel 130.

According to various aspects, the first sections 28 may define a shape that coincides with the shape of the bases 24. For example, the first sections 28 may define a quadrilateral shape that coincides with a quadrilateral shape of the bases 24. In various aspects, the first sections 28 may be slidably coupled to the bases 24 such that inner surfaces 200 of the first sections 28 slidably engage with outer surfaces 202 of the base sections 160, respectively. In further aspects, for each tap plate assembly 20, the first section 28 may include opposing side segments 204, 206 that engage with the lips 184 defined by the first side section 180 and the second side section 182 of the base section 160. For example, the first section 28 may be slightly smaller than or undersized relative to the base 24 and slidably coupled to the base 24 such that the lip 184 extends over the opposing side segments 204, 206 to retain the engagement between the tap plate 26 and the base section 160. In such examples, the lips 184 may limit movement of the first section 28 such that translation along a length of the lips 184 is permitted (e.g., generally along a longitudinal extent of the base section 160), while movement perpendicular to the base section 160 is limited or prevented.

The lateral translation of the first sections 28 of the tap plates 26 along the bases 24 may be at least partially limited by the studs 166 and slots 210 defined on the first sections 28. In some examples, for each tap plate assembly 20, the slot 210 may be defined on the first section 28 and generally align with the first stud aperture 162 and the second stud aperture 164 of the base section 160. The slots 210 may likewise define a width that coincides with a width of the first stud apertures 162 and/or the second stud apertures 164. In such examples, the coinciding width of the slots 210 with the first stud apertures 162 and the second stud apertures 164 permits extension of the studs 166 from the appliance 10, such as the wrapper 14, through the base sections 160, and through the first sections 28. In further aspects, the slot 210 may define a width that extends beyond the first stud aperture 162 and the second stud aperture 164. In such aspects, the width of the slot 210 may permit linear travel of the first section 28 along the base 24, with the abutment between the studs 166 and an inner wall 212 that encircles the slot 210 defining the amount of travel or movement of the first section 28 relative to the base 24.

Referring still to FIGS. 5-7, each tap plate assembly 20 may include fasteners 220 that operably couple the tap plate 26 to the base 24. In some examples, the fasteners 220 may couple to the studs 166 via threading defined on the studs 166. In such examples, the fasteners 220 may be configured as nuts that engage with the threading and tighten until the nut 220 abuts an outer surface 222 of the first section 28 and a compressive force is defined. The compressive force couples the first section 28 to the base 24. Additionally, or alternatively, it is generally contemplated that the fasteners 220 may be one of various kinds of fasteners, such as clips, locking levers, pins, and/or various other forms of fasteners.

The second section 30 of each tap plate 26 includes an engagement surface 230 and an inner surface 232 opposing the engagement surface 230. According to various aspects, the engagement surfaces 230 are configured to operably abut the external structure 32, such as external cabinetry 32 that is proximate the appliance 10. For example, the tap plates 26 may translate along the base sections 160 and, beyond the second side panel 38 of the wrapper 14 until the engagement surfaces 230 abut the external structure 32 proximate the appliance 10. Additionally, in such aspects, it is generally contemplated that the angle of extension of the second sections 30 relative to the first sections 28 may be at least partially determined by the abutment between the engagement surfaces 230 and the external structure 32 surrounding the appliance 10. The tap plates 26 on an opposing side of the appliance 10 may translate in an opposing direction beyond the first side panel 34 to engage the external structure 32.

Referring further to FIGS. 5-7, the engagement surfaces 230 of the tap plates 26 may be coupled to the external structure 32 via one or more fasteners. In some examples, the second sections 30 may define one or more second section apertures 240 that extend from the engagement surface 230 to the inner surface 232, respectively. In such examples, the second section apertures 240 may be configured to permit extension of one or more fasteners 220 through the respective second section aperture 240, and into the external structure 32. For example, the second section 30 may define a pair of second section apertures 240 that receive a pair of screws 220 that then extend through the pair of second section apertures 240 and into the external structure 32. The pair of screws 220 may then be tightened relative to the external structure 32 until a head of the screw abuts the inner surface 232 and a fixing force is applied on the second section 30, thereby coupling the tap plate assembly 20 to the external structure 32.

Referring still to FIGS. 2-7, each tap plate assembly 20 permits coupling of the appliance 10 to external structures 32. In particular, the sliding adjustment of the tap plates 26 relative the base sections 160 permits each tap plate assembly 20 to linearly adjust until each tap plate assembly 20 abuts the external structure 32. For example, the first tap plate assembly 20*a* and the second tap plate assembly 20*b* at the top panel 22 of the wrapper 14 can extend outward and beyond the side panels 36, 38 of the wrapper 14 until the second sections 30 of the tap plates 26 abut the external structure 32. Likewise, the third tap plate assembly 20*c* and the fourth tap plate assembly 20*d* that are disposed on the cover panel 130 can then extend outward from the cover panel 130 and beyond the side panels 36, 38 of the wrapper 14 to abut the external structure 32.

According to various aspects, each tap plate assembly 20, after being adjusted to abut the external structure 32, can be coupled to the external structure 32 via the tap plate 26 and fasteners. In this way, the appliance 10 is coupled to the external structure 32 via each tap plate assembly 20.

Referring to FIGS. 8-19, the appliance 10 includes a trim assembly 250 coupled to the wrapper 14. The trim assembly 250 may include the side trim pieces 40, which may include the trim pieces 40*a*, 40*b*, which can be collectively referred to herein as the trim pieces 40. The trim pieces 40 operably couple to the wrapper 14. In some examples, the trim assembly 250 includes the first side trim piece 40*a* coupled to the first side panel 36 and the second side trim piece 40*b* coupled to the second side panel 38 and may include a top trim piece that extends outward from the top panel 22 of the wrapper 14. In various aspects, the first trim piece 40*a* and the second trim piece 40*b* may both extend from the bottom panel 78 of the wrapper 14 and to the top panel 22 of the wrapper 14.

According to various aspects the first trim piece 40*a* and the second trim piece 40*b* are configured to extend outward from the wrapper 14 such that a space between the appliance 10 and external structure 32 is at least partially hidden. Additionally, it is generally contemplated that the first trim piece 40*a* and the second trim piece 40*b* may be mirrored configurations of the other first trim piece 40*a*, 40*b* such that the additional aspects of each trim piece 40*a*, 40*b* provided herein may likewise be an aspect of the other respective trim piece 40*a*, 40*b*.

According to various aspects, each of the side trim pieces 40 includes a first segment 254 proximate the front portion 132 of the cabinet 12 and a second segment 256 extending rearward of the first segment 254. In various aspects, the first segments 254 may have a length greater, equal to, or lesser than a length of the second segments 256. For example, the first segment 254 may have a length greater than the second segment 256 such that the first segment 254 extends beyond opposing ends of the second segment 256. The greater length of the first segment 254 relative to the second segment 256 is such that the first segment 254 may provide a greater concealment of space that can exist between the appliance 10 and the external structure 32.

Figure 9:
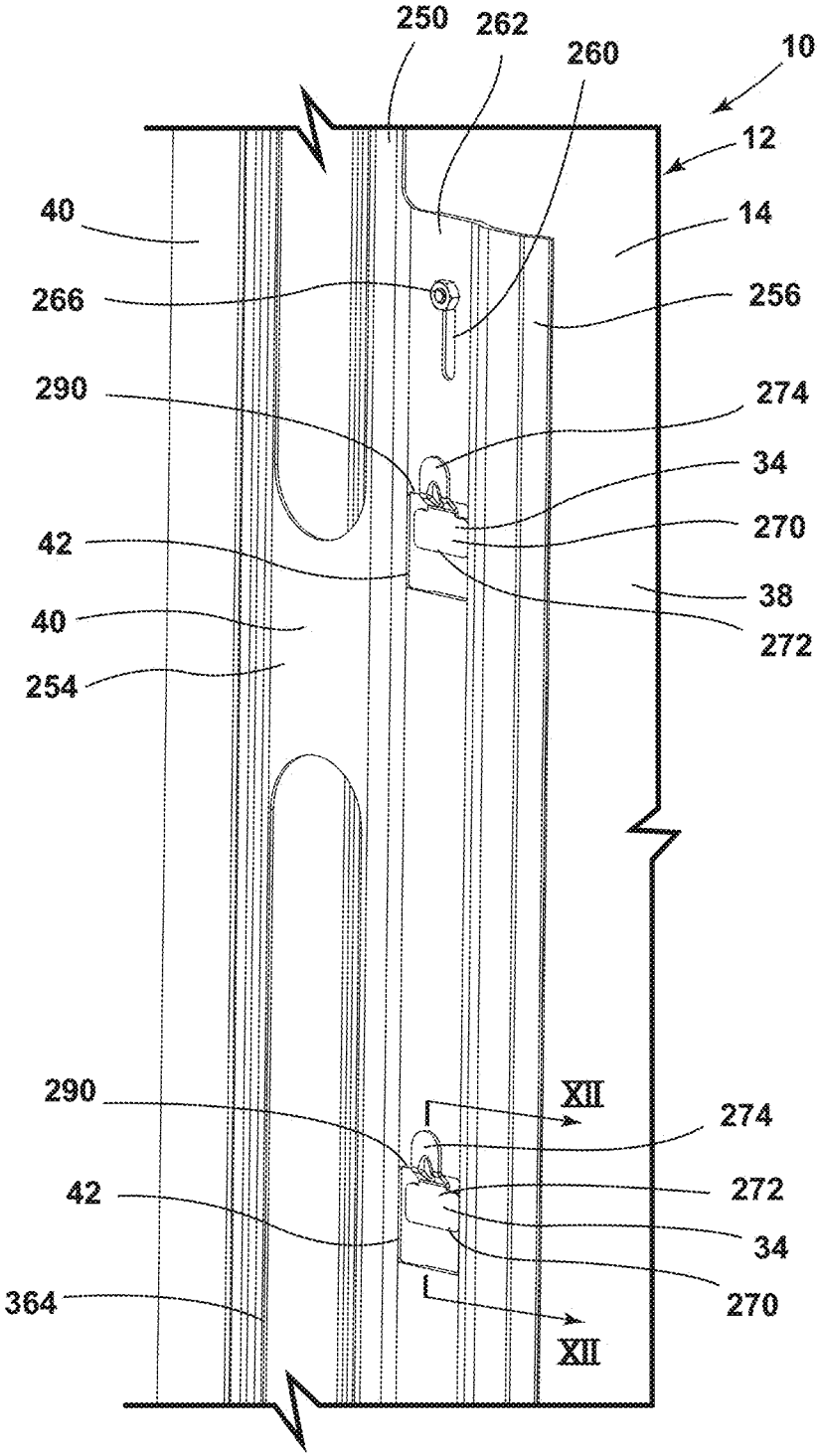
FIG. 9 is an enlarged, partial side perspective view of a vacuum insulated appliance with a side trim piece and a plurality of clips, according to the present disclosure.
Figure 10:
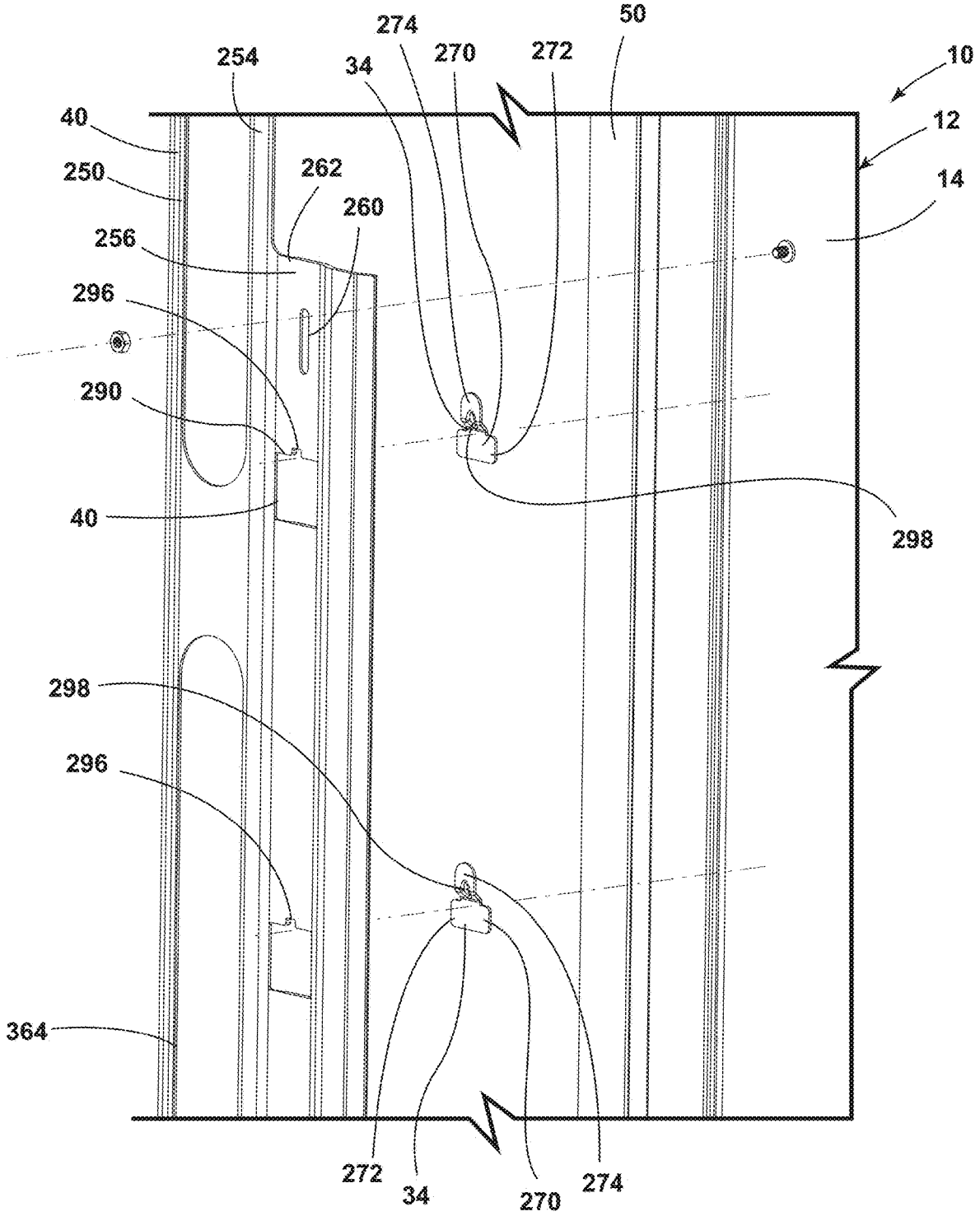
FIG. 10 is a partially exploded, side perspective view of the vacuum insulated appliance with the side trim piece and the plurality of clips of FIG. 9, taken along lines XII-XII, according to the present disclosure.

Referring to FIGS. 9 and 10, each side trim piece 40 defines a first slot 260 at a top end 262 proximate the top panel 22 of the wrapper 14 and a second slot 264 at an opposing bottom end 266 proximate the bottom panel 78 of the wrapper 14. According to various aspects, the top end 262 of each side trim piece 40 and the bottom end 266 may each be defined on the first segment 254 and/or the second segment 256 of the side trim piece 40. The first slots 260 and the second slots 264 are elongated slots and are configured to receive fasteners 268 that may at least partially couple the side trim pieces 40 to the wrapper 14. The first slots 260 and the second slots 264 are configured to permit linear adjustment of the side trim pieces 40 relative to a height of the appliance 10 during installation onto the appliance 10, as provided herein.

Referring again to FIGS. 8-17, the side trim pieces 40 define the plurality of trim apertures 42 between the first slot 260 and the second slot 264. The plurality of trim apertures 42 includes multiple trim apertures 42 that are intermittently spaced apart such that a pattern may be defined. Each trim aperture 42 may be of various sizes and may define a quadrilateral shape, a round shape, an oval shape, or one of other various shapes. In some examples, the size and/or shape of each trim aperture 42 may be at least partially determined by the plurality of fasteners 34, as provided herein.

Each side trim piece 40 is coupled to the wrapper 14 via the plurality of fasteners 34. The fasteners 34 are intermittently spaced apart such that a pattern may be defined. In some examples, the number of fasteners 34 and the placement of the fasteners 34 generally coincide with the number of trim apertures 42 and the placement of the trim apertures 42. According to various aspects, the fasteners 34 are configured to extend through the trim apertures 42 and engage with the side trim pieces 40, with this engagement operably coupling the side trim pieces 40 to the wrapper 14.

Referring still to FIGS. 8-11, the plurality of fasteners 34 may be configured as a plurality of clips 270. The clips 270 may include a first plurality of clips 270*a* and a second plurality of clips 270*b*, which can collectively be referred to herein as the clips 270. Each clip 270 includes a foot segment 272 that is coupled to the wrapper 14 and an engagement segment 274 extending from the foot segment 272. The foot segment 272 may be coupled to the wrapper 14 via one or more fasteners, welding, an adhesive, and/or other various couplings, so long as the vacuum within the vacuum insulated cavity 18 is maintained. The foot segment 272 may define one of various shapes, such as a quadrilateral shape, a rounded shape, and/or one of other various shapes.

The engagement segment 274 of each clip 270 may include a proximal segment 280 and a distal segment 282. The proximal segment 280 may be coupled to the foot segment 272 or integrally formed with the foot segment 272. The proximal segment 280 can extend acutely, perpendicular from, or obtusely from the foot segment 272. The distal segment 282 may likewise be coupled to the proximal segment 280 or integrally formed with the proximal segment 280. The distal segment 282 can extend acutely, perpendicular from, or obtusely from the foot segment 272.

For example, for each clip 270, the distal segment 282 may intersect with the proximal segment 280 at a corner segment 284 and extend from the proximal segment 280 such that the foot segment 272 and the distal segment 282 are generally parallel. According to various aspects, the distal segment 282 may define one of various shapes, such as a quadrilateral shape, a rounded shape to assist with insertion through the trim apertures 42, and/or one of other various shapes. It is further generally contemplated that the distal segment 282 may have a width, thickness, and/or length that differs or coincides with the proximal segment 280. For example, the distal segment 282 may have a greater width than the proximal segment 280, where the greater width assists in supporting the side trim piece 40.

Figure 11:
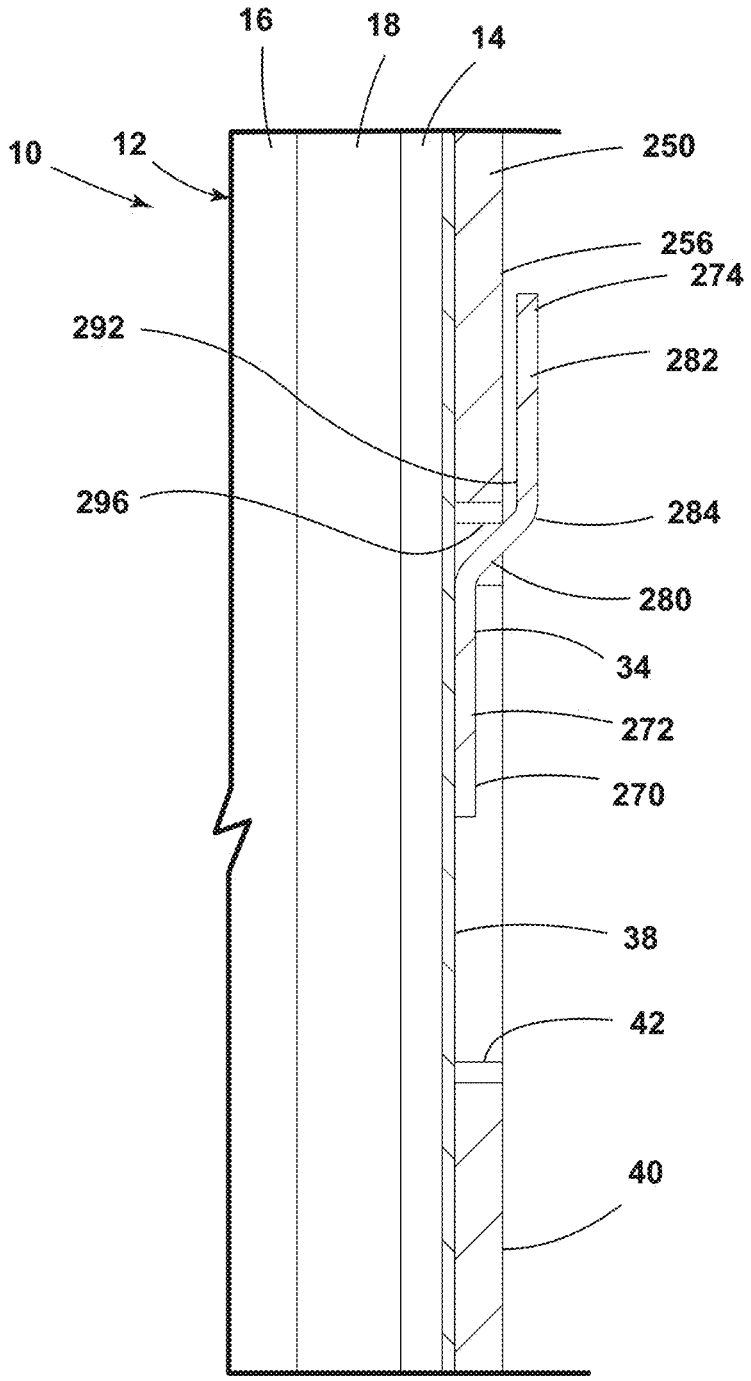
FIG. 11 is a cross-sectional view of a clip from the plurality of clips of FIG. 9, according to the present disclosure.

As illustrated in FIGS. 9 and 11, the engagement segment 274 may extend through the trim aperture 42 and upward of the trim aperture 42. In particular, the proximal segment 280 of the engagement segment 274 may extend through the trim aperture 42 and towards the top end 262 of the side trim piece 40, and the distal segment 282 may further extend upward and toward the top end 262 of the side trim piece 40.

According to various aspects, the side trim pieces 40 may be coupled to the wrapper 14 by first aligning the trim apertures 42 with the clips 270. The side trim pieces 40 may then be positioned such that the engagement segment 274 of each clip 270 extends through the respective trim aperture 42. The side trim pieces 40 may then be translated downward to an installed condition, where the downward translation provides an abutment between inner walls 290 that encircle the trim apertures 42 and abutment surfaces 292 that extends along the engagement segments 274, respectively. The abutment is then maintained by gravity acting upon the side trim pieces 40 and further provides a fixed coupling between the side trim pieces 40 and the wrapper 14. The coupling in turn, reduces a side-to-side movement of the side trim pieces 40 due to the size (i.e., the width and length) of the clips 270 relative to the size of the trim apertures 42.

According to various aspects, the trim apertures 42 can have a shape that coincides with the clips 270. In some aspects, the trim apertures 42 can have a quadrilateral shape that permits insertion of the clips 270 into the trim apertures 42. In such aspects, the quadrilateral shape may be such that the distal segment 282 is equal to or slightly undersized relative to each distal segment 282. Additionally, it is generally contemplated that each side trim piece 40 defines a trim aperture notch 296 that is upward of the trim apertures 42, respectively. The trim aperture notches 296 in turn may permit abutment between central, recessed regions 298 of the clips 270 and the inner walls 290 about the trim aperture notches 296. It is generally contemplated that the abutment between the recessed regions 298 and the inner walls 290, as well as the size of the trim aperture notches 296 relative to the recessed regions 298 is such that a side-to-side movement of the clips 270 is reduced.

Referring again to FIGS. 12-17, the plurality of fasteners 34 may be configured as a plurality of studs 300 that extend outward from the wrapper 14. Each stud 300 includes a foot section 302 that may be coupled to the wrapper 14 via one or more fasteners, welding, an adhesive, and/or other various couplings. The foot section 302 may define one or various shapes, such as a quadrilateral shape, a rounded shape, and/or other various practicable shapes. According to various aspects, each side trim piece 40 may define a foot section recess 304 on an interior surface 306 of the side trim piece 40 that has a shape and/or size that coincides with the shape and size of the foot section 302. In such configurations, the foot section recess 304, by having a size and/or shape that coincides with the shape and size of the foot section 302, may permit a flush contact between the interior surface 306 of the side trim piece 40 and the wrapper 14. In some aspects, the foot section recess 304 is slightly oversized relative to the foot section 302 and has a shape that coincides with the foot section 302 in order to guide the foot section 302 into the foot section recess 304.

Referring still to FIGS. 12-17, each stud 300 may include a neck 310 extending outward from the foot section 302. In particular, the neck 310 extends outward from the foot section 302 and the wrapper 14 and through the respective trim aperture 42. The neck 310 may be coupled to the foot section 302 or integrally formed with the foot section 302. The neck 310, in various aspects, has a shape and size that may coincide or differ with a shape and size of the foot section 302. For example, the neck 310 can have a width that is less than a width of the foot section 302. The neck 310, by having a lesser width than the foot section 302, is permitted to extend through the respective trim aperture 42 while the foot section 302 is maintained within the foot section recess 304. According to various aspects, the neck 310 may engage with a fastener, such as a trim nut 312 or E-clip 314 to couple the side trim piece 40 to the wrapper 14.

Figure 12:
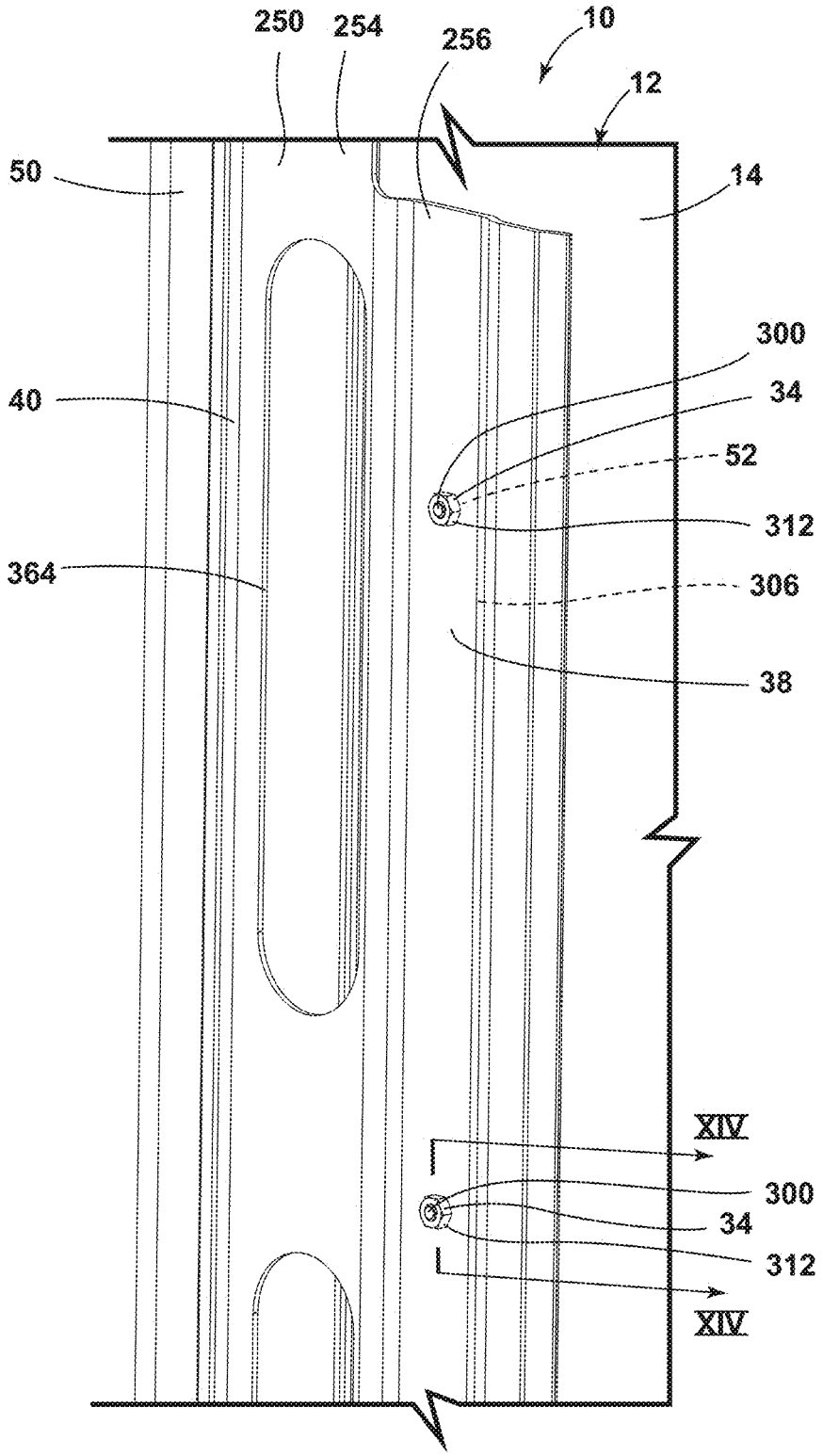
FIG. 12 is an enlarged, partial side perspective view of a vacuum insulated appliance with a side trim piece and a plurality of studs and trim nuts, according to the present disclosure.
Figure 13:
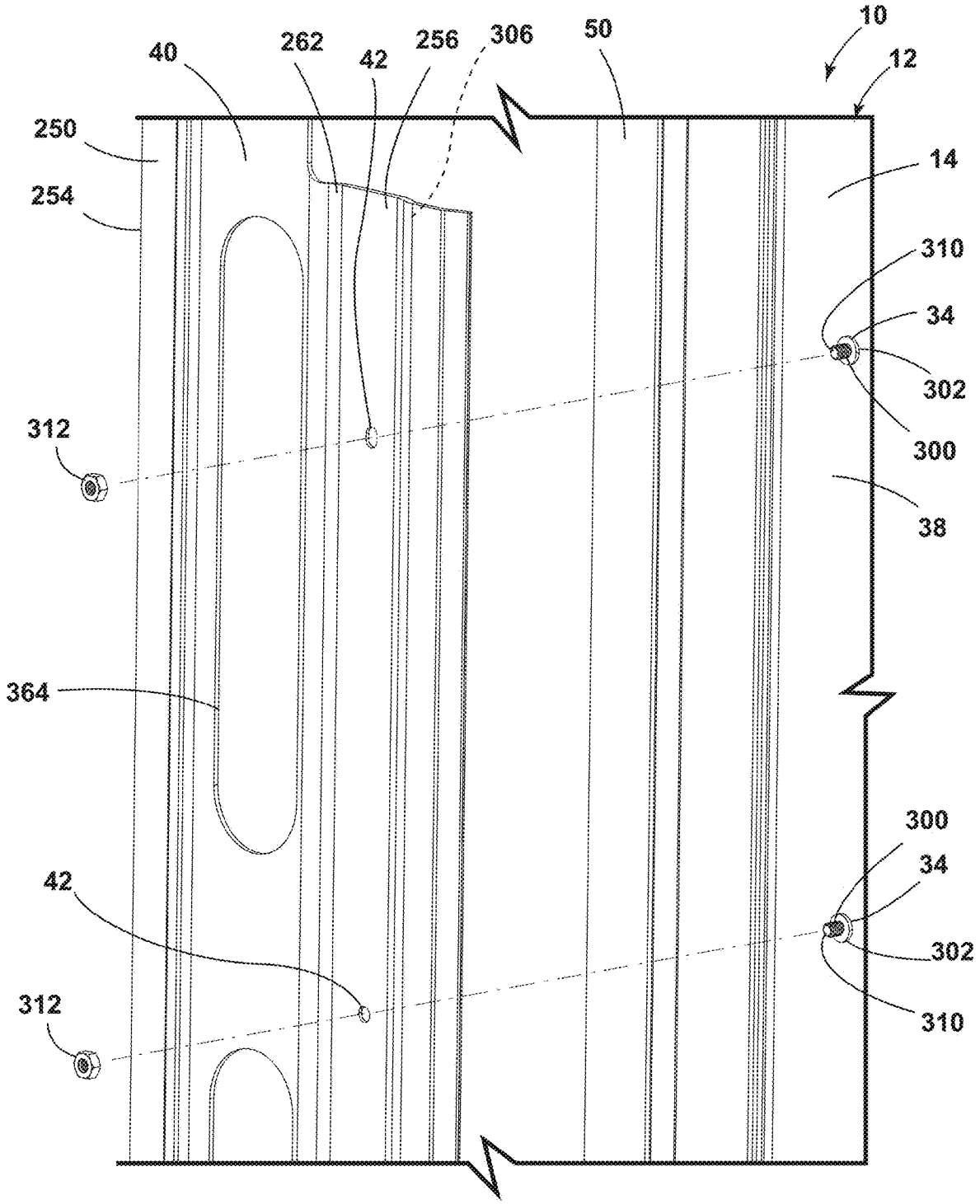
FIG. 13 is a partially exploded, side perspective view of the vacuum insulated appliance with the side trim piece and the plurality of studs and trim nuts of FIG. 12, according to the present disclosure.
Figure 14:
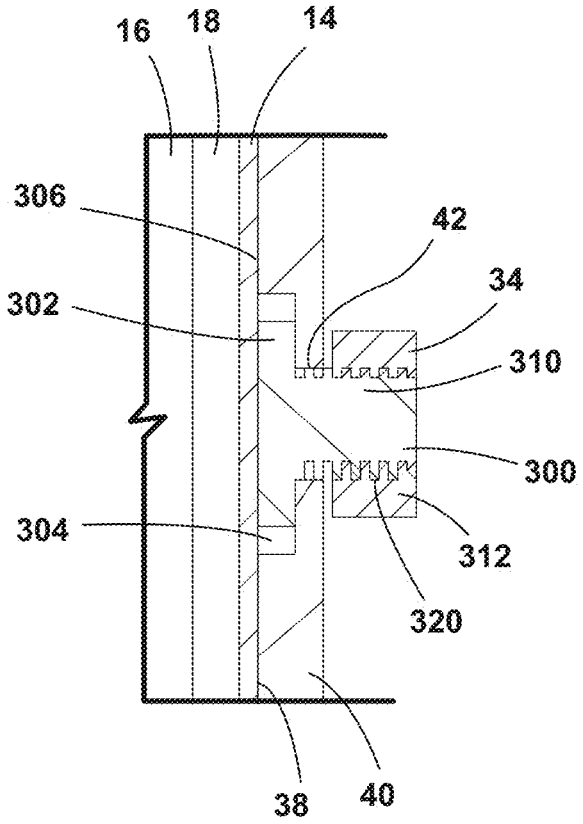
FIG. 14 is a cross-sectional view of a stud and trim nut from the plurality of studs and trim nuts of FIG. 12, taken along lines XIV-XIV, according to the present disclosure.
Figure 15:
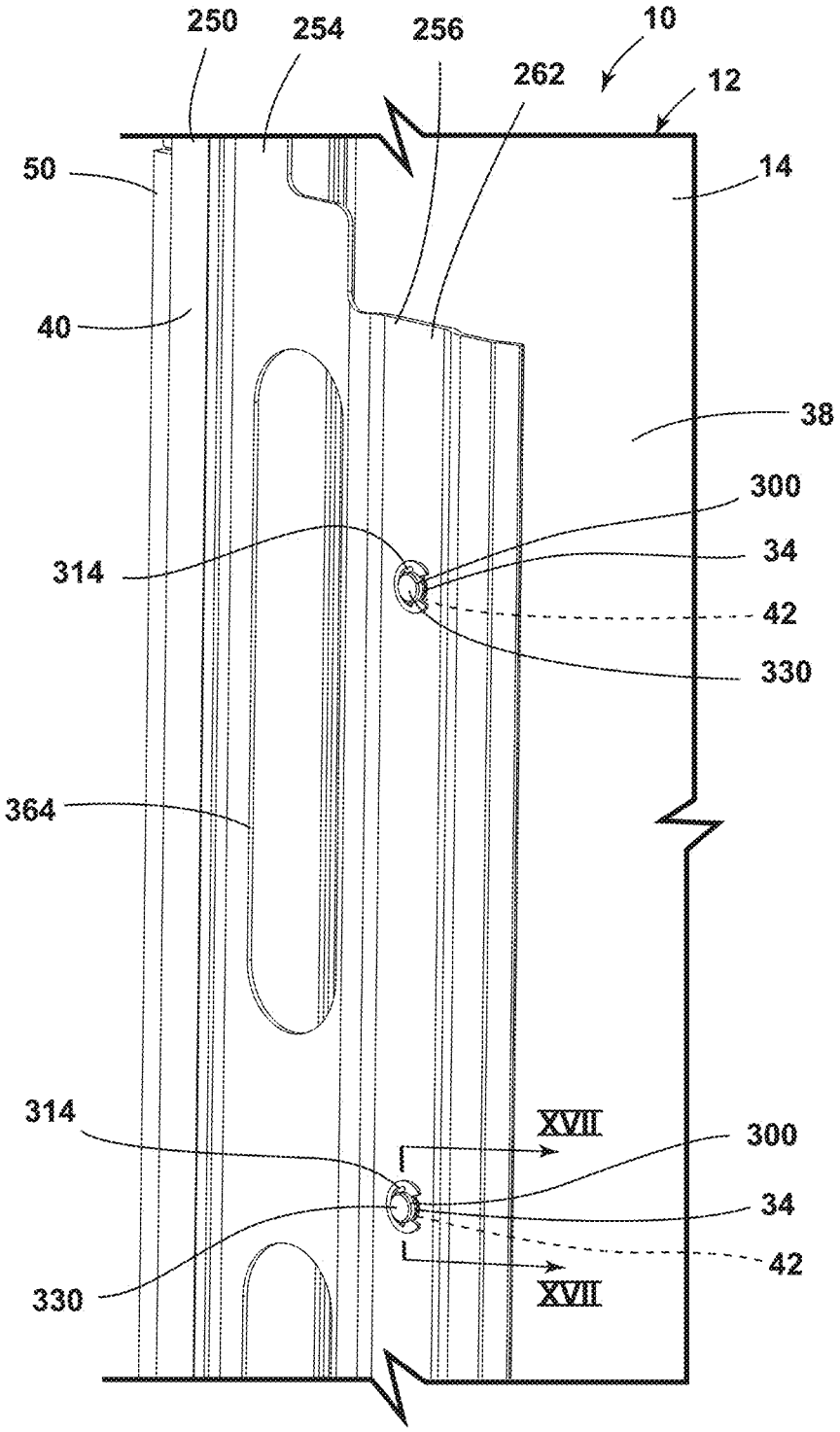
FIG. 15 is an enlarged, partial side perspective view of a vacuum insulated appliance with a side trim piece and a plurality of studs and E-clips, according to the present disclosure.
Figure 16:
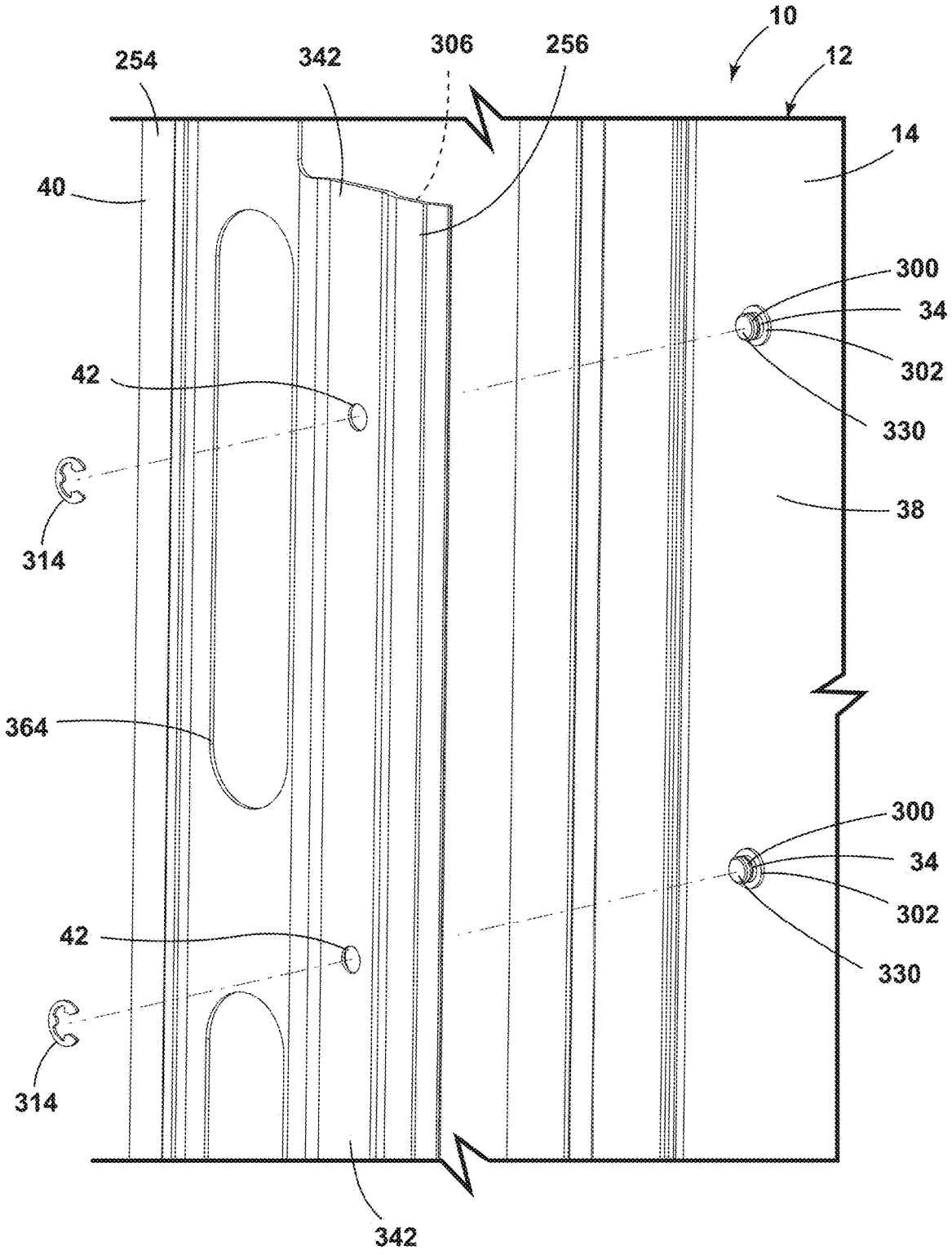
FIG. 16 is a partially exploded, partial side perspective view of the vacuum insulated appliance with the side trim piece and the plurality of studs and E-clips of FIG. 15, according to the present disclosure.
Figure 17:
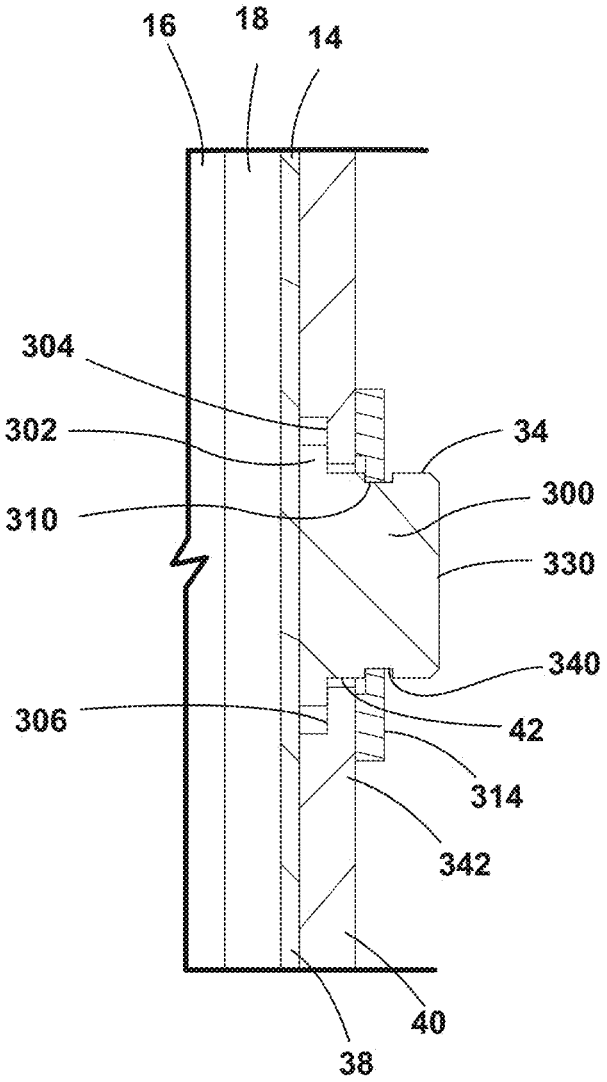
FIG. 17 is a cross-sectional view of a stud and E-clip from the plurality of studs and E-clips of FIG. 15, taken along lines XVII-XVII, according to the present disclosure.

Referring still to FIGS. 12-14, each stud 300 may define threading 320 along the neck 310 thereof. The threading 320 permits engagement between the neck 310 of the stud 300 and the respective trim nut 312, which defines mating threading. For example, the threading 320 may define a thread count and pitch that coincides with the thread count and pitch on the trim nut 312. According to various aspects, the trim nut 312 may engage with the threading 320 and tighten inward and toward the foot section 302 until a compressive force is exerted upon the side trim piece 40. The compressive force exerted upon the side trim piece 40 by each trim nut 312 that engages with the respective neck 310 from the studs 300 may sufficiently couple the side trim piece 40 to the wrapper 14.

Referring again to FIGS. 15-17, each stud 300 may include a head 330 at an end of the neck 310. The head 330 may be coupled or integrally formed with the neck 310 of the stud 300. The head 330 may have a shape and/or size that coincides with or differs from the shape and size of the neck 310 and/or the foot section 302. For example, the head 330 may define a cylindrical shape that is coaxial with a cylindrical shape of the neck 310, with the head 330 and the foot section 302 having widths that are greater than the width of the neck 310. Additionally, the head 330 can define a cylindrical shape that is coaxial with the cylindrical shape of the neck 310 and the foot section 302, with the head 330 having a width greater than the neck 310 and/or lesser than the foot section 302. In such aspects, the lesser width of the head 330 relative to the foot section 302 permits insertion of the head 330 and the neck 310 through the foot section recess 304, while still maintaining the foot section 302 within the foot section recess 304.

According to various aspects, the stud 300 may be configured to receive the E-clip 314. In particular, the foot section 302, the neck 310, and the head 330 may each have a shape and/or size such that a groove 340 is defined. The groove 340 is configured to receive the E-clip 314. For example, the foot section 302 and the head 330 have widths that are greater than a width of the neck 310, where the lesser width of the neck 310 defines the groove 340.

The lessened width of the neck 310 may be such that the groove 340 is defined around an outer periphery of the stud 300. In such examples, the width and/or thickness of the head 330 and foot section 302 may be at least partially determined by the width of E-clip 314. For example, the foot section 302 and/or the head 330 may have widths and thicknesses such that the groove 340 is defined outward of an exterior surface 342 of the side trim piece 40, and the E-clip 314 abuts the exterior surface 342 and the head 330 of the stud 300. The abutment of the E-clip 314 against the exterior surface 342 and the head 330 provides a retainment such that the side trim piece 40 is coupled to the wrapper 14.

Figure 18:
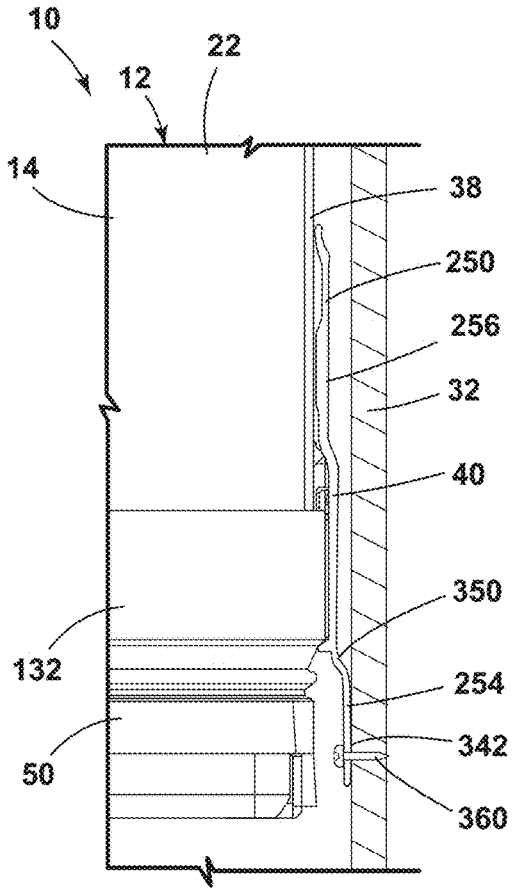
FIG. 18 is a partial top elevational view of an appliance with a side trim piece that includes a first segment and a second segment, according to the present disclosure.
Figure 19:
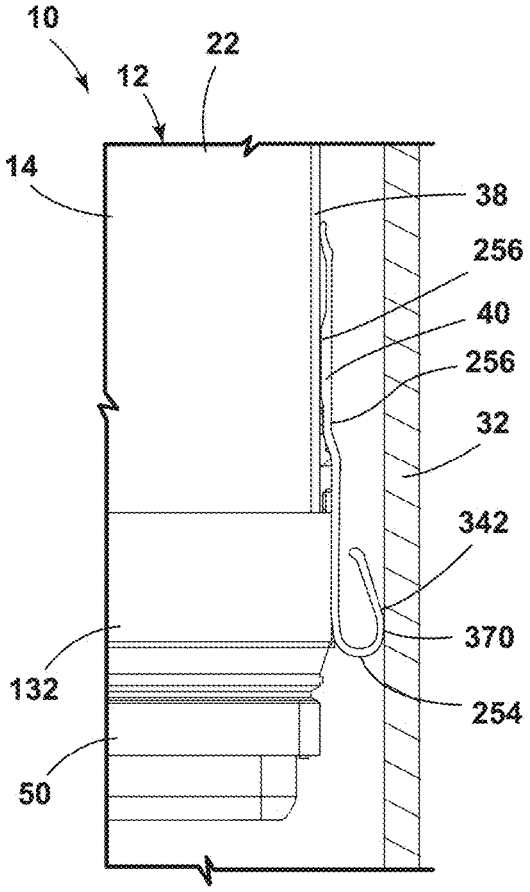
FIG. 19 is a partial top elevational view of an appliance with a side trim piece that includes a front segment with a broadened region and a second segment, according to the present disclosure.

Referring now to FIGS. 18 and 19, each side trim piece 40 includes the first segment 254 and the second segment 256.

As provided herein, the first segment 254 is disposed proximate the front portion 132 of the cabinet 12, and the second segment 256 extends rearward from the first segment 254. In some examples, the second segment 256 may extend substantially parallel with the first segment 254. In other aspects, the second segment 256 may extend acutely or obtusely from the first segment 254. In yet other aspects, the second segment 256 may be offset from the first segment 254. For example, the side trim piece 40 may define a stepped segment 350 between the first segment 254 and the second segment 256, where the stepped segment 350 acutely or obtusely extends from the first segment 254 and/or the second segment 256. Additionally, the first segment 254, the second segment 256, and the stepped segment 350 may define various shapes, sizes, and thicknesses that may coincide or differ from the other segments 254, 256, 350.

According to various aspects, the side trim pieces 40, or a portion thereof, may be made from a material that provides or defines a spring tension. In some examples, the first segments 254 of the side trim pieces 40 define the spring tension that permits bending or elastic deformation of the first segments 254. For example, the first segment 254 may be made of a material with sufficient spring tension such that the first segment 254 may be bent outwards towards external cabinetry 32 to reduce a visible gap between the side trim piece 40 and the external cabinetry 32. The first segment 254 may then be coupled to the external cabinetry 32 via a first segment fastener 360.

Additionally, it is generally contemplated that various other segments 256, 350 of the side trim piece 40 may define a spring tension. For example, the stepped segment 350 may define a spring tension such that the first segment 254 moves about the stepped segment 350 towards the external cabinetry 32. According to various aspects, the spring tension can be such that the first segment 254 biases away from the external structure 32 and towards the appliance 10 when uncoupled from the external structure 32 and/or when an outward directed force is not applied to the first segment 254. This spring tension, in turn, permits adjustment of the appliance 10 relative to the external structure 32 when the first segment 254 is distal and/or decoupled from the external structure 32. Additionally, the spring tension can provide structural integrity of the side trim piece 40 as the first segment 254 is repeatedly moved outward from the appliance 10 and towards the external structure 32.

According to various aspects, the side trim pieces 40 may define one or more elongated apertures 364 that assist in permitting bending of the first segment 254 towards the external structure 32. In some aspects, the first segment 254 and/or the stepped segment 350 defines elongated apertures 364 along the first segment 254 and/or the stepped segment 350. The elongated apertures 364, by extending along a height of the side trim pieces 40, reduce the amount of material in the side trim pieces 40. The reduced material, in turn, reduces the weight of the side trim piece 40 and can reduce the amount of force utilized to bend the first segment 254 towards the external structure 32. For example, first segment 254 can define the elongated apertures 364 such that material is removed from the first segment 254 and a lesser force is needed for a bending moment of the side trim piece 40.

Referring to FIG. 19, each side trim piece 40 may define a broadened region 370. In some examples, the broadened regions 370 may be defined by a bend in the first segment 254. As illustrated in FIG. 19, the first segment 254 may define a U-shaped bend that provides the broadened region 370. The broadened region 370 is positioned in a space defined between the wrapper 14 and the external cabinetry 32 such that the space is reduced or hidden due to the abutment of the broadened region 370 with the wrapper 14 and the external cabinetry 32.

Referring to FIGS. 1-19, the appliance 10 having the tap plate assemblies 20 couplable to the wrapper 14 provides for an appliance 10 that may be housed and coupled to various enclosures (e.g., structures 32). In particular, the slideability of the tap plates 26 along the base sections 160 permits adjustability of the tap plates 26 relative to the external cabinetry 32 before fixing the tap plates 26 to the bases 24 via the nuts 220. This adjustability is such that the tap plates 26 may be selectively positioned, depending on the location of the external cabinetry 32 relative to the appliance 10.

Additionally, the use of the clips 270 with the side trim pieces 40 provides for an efficient installation of the side trim pieces 40. In particular, the clips 270, by each having the foot segment 272 and the engagement segment 274 offset and extending from the foot segment 272, permits installation of the side trim pieces 40 to the wrapper 14 by positioning the plurality of trim apertures 42 of the side trim pieces 40 relative to the clips 270 and translating the side trim pieces 40 generally downward. Once translated downward, the side trim pieces 40 are coupled to the wrapper 14 via engagements between the clips 270 and the side trim pieces 40.

Further, the use of the studs 300 and the trim nuts 312 to couple the side trim pieces 40 to the wrapper 14 likewise provides for an efficient installation of the side trim pieces 40. In particular, the studs 300, by each defining threading 320 and extending through the plurality of trim apertures 42, permits installation of the side trim pieces 40 by positioning the plurality of trim apertures 42 over the plurality of studs 300 and then tightening the plurality of trim nuts 312 onto the plurality of studs 300.

Further still, the use of the plurality of studs 300 with the engagement between the E-clip 314 and grooves 340 of the studs 300 also provides for an efficient installation of the side trim pieces 40. In particular, the studs 300, by each defining the groove 340 between the foot section 302 and the head 330, permits installation of the side trim pieces 40 by positioning the plurality of trim apertures 42 over the plurality of studs 300 and then snapping the e-clips 314 onto each respective groove 340.

Furthermore, the spring tension of the side trim pieces 40 provides for side trim pieces 40 that may reduce or hide space that may exist between the appliance 10 and external structure 32. In particular, the spring tension of the side trim pieces 40 permits bending of the side trim pieces 40, or a segment 254, 256, 350 thereof, such that the side trim pieces 40 may be bent towards the external structure 32 and fastened to the external structure 32 so that the space may be reduced or hidden.

Additionally, the broadened regions 370 of the side trim pieces 40 likewise provide for side trim pieces 40 that may reduce or hide space that may exist between the appliance 10 and external structure 32, such as external cabinetry 32. In particular, the broadened regions 370 of the side trim pieces 40, by having a broadened width, reduce or hide the space between the appliance 10 and external structure 32.

According to various examples, the tap plate assemblies 20, the side trim pieces 40, and/or various components of the appliance 10 provided herein can be used in various appliances. These appliances can include, but are not limited to, refrigerators, freezers, coolers, dishwashers, and other similar appliances and fixtures within household and commercial settings.

Referring further to FIGS. 1-19, the present disclosure provides for a variety of advantages. For example, the use of the tap plate assemblies 20 provides for an appliance 10 that can be coupled to external structure 32, such as external cabinetry, that may be of varying distance from the appliance 10. In particular, the tap plates 26, by being slidably coupled to the bases 24, may linearly adjust until the tap plates 26 are abutting the external structure 32, where the tap plates 26 may then be coupled to the external structure 32 and fixed to the bases 24. Additionally, the tap plate assemblies 20, by being coupled to the wrapper 14 without puncturing the vacuum insulated cavity 18, advantageously provides for an appliance 10 that can be coupled to external structures 32 of various sizes and distances from the appliance 10, while still maintaining the vacuum within the vacuum insulated cavity 18.

Further, the plurality of fasteners 34 disposed on the wrapper 14 further provides for a variety of advantages. For example, the plurality of fasteners 34 that extend through the plurality of trim apertures 42 defined on the side trim pieces 40 provides for a side trim piece 40 that may be efficiently coupled to the wrapper 14. In particular, the side trim pieces 40 may be positioned such that the plurality of fasteners 34 are inserted through the plurality of trim apertures 42 and the side trim piece 40 is coupled to the wrapper 14. In particular, the extension of the fasteners 34 through the trim apertures 42 provides for an efficient alignment of the side trim pieces 40 on the wrapper 14, and the coupling between the fasteners 34 and the trim apertures 42 provides for an efficient installation. Additionally, the plurality of fasteners 34, by being coupled to the wrapper 14 without puncturing the vacuum insulated cavity 18, provide for a side trim piece 40 that can be efficiently installed while still maintaining the vacuum within the vacuum insulated cavity 18.

Referring again to FIGS. 1-19, the side trim pieces 40 further provide for additional advantages. For example, in aspects where the side trim pieces 40 have one or more segments 254, 256, 350 with a spring tension, the side trim pieces 40 may effectively reduce or eliminate a gap between the appliance 10 and the external structure 32, while also permitting decoupling of the first segments 254 from the external structure 32 and adjustment of the appliance 10 relative to the external structure 32. Additionally, the spring tension of the side trim pieces 40 advantageously provides for a range in permitted space between the appliance 10 and the external structure 32, as the side trim pieces 40 can flex and couple to external structure 32 of varying distances from the appliance 10. This variation, in turn, permits the placement of appliances 10 of varying sizes within a gap or cavity defined by the external structure 32.

Similarly, in aspects where the side trim pieces 40 have a broadened region 370, such as when the first segment 254 defines a general U-shape, the side trim pieces 40 may likewise effectively reduce or eliminate the gap between the appliance 10 and external structure 32 as the broadened regions 370 have a width that extends from the appliance 10 and to the external structure 32. Additionally, the broadened regions 370, by wedging between the appliance 10 and the external structure 32, can eliminate the gap between the appliance 10 and the external structure 32, while also providing a retaining force that can assist in keeping the appliance 10 in a fixed position. Additional benefits and advantages for the components disclosed herein may be realized and/or achieved.

This device disclosed herein is further summarized in the following paragraphs and is further characterized by combinations of any and all of the various aspects described herein.

According to one aspect of the present disclosure, a vacuum insulated appliance includes a cabinet with a wrapper that includes a top panel, a first side panel, and a second side panel and a liner coupled to the wrapper. The vacuum insulated cavity is defined between the wrapper and the liner. A pair of tap plate assemblies are coupled to the top panel of the wrapper. Each of the pair of tap plate assemblies includes a base coupled to the top panel and a tap plate with a first section slidably coupled to the base and a second section that extends from the first section and away from the top panel. The second section is configured to couple to an external structure that is spaced from the cabinet. The vacuum insulated appliance also includes fasteners protruding outward from the first side panel and the second side panel of the wrapper, respectively, and a pair of side trim pieces coupled to the first side panel and the second side panel, respectively. Each side trim piece defines trim apertures. The fasteners extend through the trim apertures and engage with the pair of side trim pieces to couple the pair of side trim pieces to the first side panel and the second side panel, respectively.

According to another aspect, a vacuum insulated appliance includes a second pair of tap plate assemblies and a cabinet includes a cover panel coupled to a front portion thereof, and the second pair of tap plate assemblies is coupled to opposing ends of the cover panel.

According to another aspect, fasteners are configured as clips that each include a boot segment and an engagement segment extending from the boot segment. The engagement segments extend through a respective trim aperture and abut an inner wall that encircles the trim aperture.

According to another aspect, clips further include a stepped segment between a boot segment and an engagement segment, and the boot segment is parallel with the engagement segment.

According to another aspect, each of a pair of side trim pieces defines a first slot at a top end thereof and a second slot is at a bottom end thereof. The first slots and the second slots permit translation of each side trim piece to an installed condition, where engagement segments abut inner walls of trim apertures.

According to another aspect, fasteners are configured as threaded studs that extend from a wrapper and through trim apertures, and threaded studs are configured to engage with trim nuts that couple a pair of side trim pieces to the wrapper.

According to another aspect, each of a pair of side trim pieces includes a first segment, a second segment extending rearward from the first segment, and a stepped segment between the first segment and the second segment and at least one of the first segment and the stepped segment define a spring tension. The spring tension is configured to permit bending of the first segment and abutment between the first segment and an external structure.

According to another aspect, each of a pair of side trim pieces includes a first segment and a second segment extending rearward from the first segment, and the first segment defines a U-shaped bend to form a broadened region. The broadened region is configured to abut the wrapper and external structure that is spaced from the wrapper.

According to another aspect of the present disclosure, a refrigeration appliance includes a cabinet that includes a wrapper with a top panel, a bottom panel opposing the top panel, a first side panel, and a second side panel opposing the first side panel and a liner coupled to the wrapper. The refrigeration appliance includes a cover panel coupled to a front portion of the wrapper, a first pair of tap plate assemblies coupled to the top panel of the wrapper, and a second pair of tap plate assemblies coupled to the cover panel. Each of the first pair of tap plate assemblies and each of the second pair of tap plate assemblies include a base, a tap plate with a first section slidably coupled to the base, and a second section extending from the first section, where the second section is configured to couple to external cabinetry. The refrigeration appliance further includes a pair of side trim pieces that are coupled to the first side panel and the second side panel of the wrapper. The pair of side trim pieces extend from a bottom panel of the wrapper to the top panel of the wrapper.

According to another aspect, each base includes a base section and lips extending along opposing sides of the base section. The lips are configured to slidably engage with a first section of a respective tap plate.

According to another aspect, studs extend from a top panel of the wrapper and a cover panel, where each of a first pair of tap plate assemblies and each of a second pair of tap plate assemblies each include a pair of stud apertures defined on a base and a slot defined on a first section. The pair of stud apertures and the slot permit extension of the studs through the first section.

According to another aspect, each slot aligns with a pair of stud apertures and extends beyond the pair of stud apertures on a respective base, and the slot permits linear translation of a first section along the bases, respectively.

According to another aspect, each of a pair of side trim pieces includes a first segment, a second segment extending rearward from the first segment, a stepped segment between the first segment and the second segment, and at least one of the first segment and the stepped segment define a spring tension. The spring tension is configured to permit bending of the first segment and abutment between the first segment and an external structure.

According to another aspect, each of a pair of side trim pieces include a first segment and a second segment extending rearward from the first segment, and the first segment defines a U-shaped bend to form a broadened region. The broadened region is configured to abut a wrapper and an external structure that is spaced from the wrapper.

According to another aspect of the present disclosure, a vacuum insulated appliance includes a cabinet. The cabinet includes a wrapper with a top panel, a bottom panel opposing the top panel, a first side panel, and a second side panel opposing the first side panel, and a liner coupled to the wrapper. The cabinet also includes a cover panel coupled to a front portion of the wrapper and tap plate assemblies coupled to at least one of the wrapper and the cover panel. The tap plate assemblies each include a base, studs extending outward from the at least one of the wrapper and the cover panel, and a tap plate with a first section slidably coupled to the base and a second section extending from the first section and away from the at least one of the wrapper and the cover panel. Each of the first sections define a slot that permits extension of the studs through the first section, respectively. The second section is configured to couple to external cabinetry.

According to another aspect, each base includes a base section and lips extending along opposing sides of the base section. The lips are configured to slidably engage with a first section of a respective tap plate.

According to another aspect, each slot permits linear translation of a first section along the base, respectively.

According to another aspect, tap plate assemblies include a first pair of tap plate assemblies coupled to a top panel of a wrapper and a second pair of tap plate assemblies coupled to a cover panel.

According to another aspect, each second section of tap plates of a first pair of tap plate assemblies extend outward from a top panel. Each second section of tap plates of a second pair of tap plate assemblies extend outward from a cover panel and perpendicular from relative to the second sections of the tap plates of the first pair of tap plate assemblies.

According to another aspect, each tap plate of tap plate assemblies is configured to extend beyond at least one of a first side panel and a second side panel of a wrapper.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A vacuum insulated appliance, comprising:

a cabinet including:

a wrapper including a top panel, a first side panel, and a second side panel;

a liner coupled to the wrapper, wherein a vacuum insulated cavity is defined between the wrapper and the liner; and a cover panel coupled to a front portion thereof;

a first pair of tap plate assemblies coupled to the top panel of the wrapper, wherein each of the first pair of tap plate assemblies includes:

a base coupled to the top panel; and a tap plate with a first section slidably coupled to the base and a second section that extends from the first section and away from the top panel, wherein the second section is configured to couple to an external structure that is spaced from the cabinet;

a second pair of tap plate assemblies, wherein the second pair of tap plate assemblies is coupled to opposing ends of the cover panel;

fasteners protruding outward from the first side panel and the second side panel of the wrapper, respectively; and a pair of side trim pieces coupled to the first side panel and the second side panel, respectively, wherein each said side trim piece defines trim apertures, and wherein the fasteners extend through the trim apertures and engage with the pair of side trim pieces to couple the pair of side trim pieces to the first side panel and the second side panel, respectively.

2. The vacuum insulated appliance of claim 1, wherein the fasteners are configured as clips that each include a boot segment and an engagement segment extending from the boot segment, and wherein the engagement segments extend through respective said trim apertures and abut with an inner wall that encircles the trim aperture.

3. The vacuum insulated appliance of claim 2, wherein the clips further include a stepped segment between the boot segment and the engagement segment, and wherein the boot segment is parallel with the engagement segment.

4. The vacuum insulated appliance of claim 2, wherein each of the pair of side trim pieces defines a first slot at a top end thereof and a second slot at a bottom end thereof, and wherein the first slots and the second slots permit translation of each said side trim piece to an installed condition where the engagement segments abut the inner walls that encircle the trim apertures.

5. The vacuum insulated appliance of claim 1, wherein the fasteners are configured as threaded studs that extend from the wrapper and through the trim apertures, and wherein the threaded studs are configured to engage with trim nuts that couple the pair of side trim pieces to the wrapper.

6. The vacuum insulated appliance of claim 1, wherein each of the pair of side trim pieces includes:

a first segment;

a second segment extending rearward from the first segment; and a stepped segment between the first segment and the second segment, wherein at least one of the first segment and the stepped segment define a spring tension, the spring tension being configured to permit bending of the first segment and abutment between the first segment and the external structure.

7. The vacuum insulated appliance of claim 1, wherein each of the pair of side trim pieces includes:

a first segment; and a second segment extending rearward from the first segment, and wherein the first segment defines a U-shaped bend to form a broadened region, the broadened region configured to abut the wrapper and the external structure that is spaced from the wrapper.

8. A refrigeration appliance, comprising:

a cabinet including:

a wrapper with a top panel, a bottom panel opposing the top panel, a first side panel, and a second side panel opposing the first side panel; and a liner coupled to the wrapper;

a cover panel coupled to a front portion of the wrapper;

a first pair of tap plate assemblies coupled to the top panel of the wrapper;

a second pair of tap plate assemblies coupled to the cover panel, wherein each of the first pair of tap plate assemblies and each of the second pair of tap plate assemblies includes a base and a tap plate with a first section slidably coupled to the base and a second section extending from the first section, wherein the second section is configured to couple to external cabinetry; and a pair of side trim pieces coupled to the first side panel and the second side panel of the wrapper, wherein the pair of side trim pieces extend from the bottom panel of the wrapper to the top panel of the wrapper.

9. The refrigeration appliance of claim 8, wherein each said base includes a base section and lips extending along opposing sides of the base section, wherein the lips are configured to slidably engage with the first section of a respective said tap plate.

10. The refrigeration appliance of claim 8, further comprising:

studs extending from the top panel of the wrapper and the cover panel, wherein each of the first pair of tap plate assemblies and each of the second pair of tap plate assemblies includes a pair of stud apertures defined on the base and a slot defined on the first section, the pair of stud apertures and the slot permitting extension of the studs through the first section.

11. The refrigeration appliance of claim 10, wherein each said slot aligns with the pair of stud apertures and extends beyond the pair of stud apertures on a respective said base, and wherein the slots permit linear translation of the first sections along the bases, respectively.

12. The refrigeration appliance of claim 8, wherein each of the pair of side trim pieces includes:

a first segment;

a second segment extending rearward from the first segment; and a stepped segment between the first segment and the second segment, wherein at least one of the first segment and the stepped segment define a spring tension, the spring tension being configured to permit bending of the first segment and abutment between the first segment and an external structure.

13. The refrigeration appliance of claim 8, wherein each of the pair of side trim pieces each include a first segment and a second segment extending rearward from the first segment, and wherein the first segment defines a U-shaped bend to form a broadened region, the broadened region configured to abut the wrapper and an external structure that is spaced from the wrapper.

14. A vacuum insulated appliance, comprising:

a cabinet including:

a wrapper with a top panel, a bottom panel opposing the top panel, a first side panel, and a second side panel opposing the first side panel; and a liner coupled to the wrapper;

a cover panel coupled to a front portion of the wrapper; and tap plate assemblies coupled to at least one of the wrapper and the cover panel, wherein the tap plate assemblies each include a base, studs extending outward from the at least one of the wrapper and the cover panel, and a tap plate with a first section slidably coupled to the base and a second section extending from the first section and away from the at least one of the wrapper and the cover panel, and wherein each of the first sections defines a slot that permits extension of the studs through the first section, respectively, and wherein the second section is configured to couple to external cabinetry.

15. The vacuum insulated appliance of claim 14, wherein each said base includes a base section and lips extending along opposing sides of the base section, wherein the lips are configured to slidably engage with the first section of a respective said tap plate.

16. The vacuum insulated appliance of claim 14, wherein each said slot permits linear translation of the first section along the base, respectively.

17. The vacuum insulated appliance of claim 14, wherein the tap plate assemblies include:

a first pair of tap plate assemblies coupled to the top panel of the wrapper; and a second pair of tap plate assemblies coupled to the cover panel.

18. The vacuum insulated appliance of claim 17, wherein each said second section of the tap plates of the first pair of tap plate assemblies extend outward from the top panel, and wherein each said second section of the tap plates of the second pair of tap plate assemblies extend outward from the cover panel and perpendicular relative to the second sections of the tap plates of the first pair of tap plate assemblies.

19. The vacuum insulated appliance of claim 14, wherein each said tap plate of the tap plate assemblies is configured to extend beyond at least one of the first side panel and the second side panel of the wrapper.

* * * * *